US011110996B2

(12) United States Patent
Overbye et al.

(10) Patent No.: US 11,110,996 B2
(45) Date of Patent: Sep. 7, 2021

(54) RECREATIONAL WATERCRAFT WITH BALLAST SYSTEM

(71) Applicant: Tulip Factory, LLC, Elk River, MN (US)

(72) Inventors: Mark Overbye, Elk River, MN (US); Abdul Hameed Khanzada, Loveland, CO (US)

(73) Assignee: Tulip Factory, LLC, Elk River, MN (US)

( * ) Notice: Subject to any disclaimer, the term of this patent is extended or adjusted under 35 U.S.C. 154(b) by 9 days.

(21) Appl. No.: 16/784,602

(22) Filed: Feb. 7, 2020

(65) Prior Publication Data

US 2021/0245848 A1 Aug. 12, 2021

(51) Int. Cl.

| | |
|---|---|
| ***B63B 34/70*** | (2020.01) |
| ***B63B 1/32*** | (2006.01) |
| ***B63B 11/04*** | (2006.01) |
| ***B63B 43/06*** | (2006.01) |
| ***B63B 13/00*** | (2006.01) |

(52) U.S. Cl.

CPC ..... *B63B 34/70* (2020.02); *B63B 1/32* (2013.01); *B63B 11/04* (2013.01); *B63B 13/00* (2013.01); *B63B 43/06* (2013.01); *B63B 2207/02* (2013.01)

(58) Field of Classification Search

CPC .. B63B 34/70; B63B 1/00; B63B 1/32; B63B 11/00; B63B 11/04; B63B 13/00; B63B 39/00; B63B 39/03; B63B 43/00; B63B 43/06; B63B 2207/02

USPC ..... 114/121, 125, 356

See application file for complete search history.

(56) References Cited

U.S. PATENT DOCUMENTS

| | | | | |
|---|---|---|---|---|
| 3,503,358 | A * | 3/1970 | Moesly | B63B 43/06 114/125 |
| 6,044,788 | A * | 4/2000 | Larson | B63B 34/00 114/125 |
| 6,427,616 | B1 * | 8/2002 | Hagen | B63B 1/32 114/125 |
| 6,532,889 | B1 * | 3/2003 | Goad | B63B 39/061 114/356 |
| 6,953,002 | B2 | 10/2005 | Jenssen et al. | |
| 7,140,318 | B1 | 11/2006 | Gasper | |
| 8,038,875 | B2 * | 10/2011 | Fukuyo | B63J 4/004 210/137 |
| 8,171,870 | B2 | 5/2012 | Gasper | |

(Continued)

OTHER PUBLICATIONS

Lake Assault Boats, LLC, Clinton 36, retrieved from website: http://www.lakeassault.com/boats/clinton-36/ on Jan. 30, 2020, 3 pages, Clinton, IA.

(Continued)

*Primary Examiner* — Lars A Olson

(74) *Attorney, Agent, or Firm* — Brooks, Cameron & Huebsch, PLLC

(57) ABSTRACT

Recreational watercraft and methods of operating recreational watercraft are described. Recreational watercraft can include an aluminum hull, a plurality of ballast tanks, a first surface defining a first opening that extends from an interior of a ballast tank of the plurality of ballast tanks to an exterior of the hull, a valve configured to selectively open or close the first opening, and a second surface defining a second opening that is fixed permanently open and extends from an interior of the ballast tank through a bottom portion of the hull to an exterior of the hull.

17 Claims, 14 Drawing Sheets

(56) References Cited

U.S. PATENT DOCUMENTS

| | | | | |
|---|---|---|---|---|
| 8,171,874 | B2 | 5/2012 | Gasper | |
| D666,135 | S | 8/2012 | Gasper | |
| D678,168 | S | 3/2013 | Gasper | |
| D686,968 | S | 7/2013 | Gasper | |
| D686,970 | S | 7/2013 | Gasper | |
| 8,485,119 | B2 | 7/2013 | Gasper | |
| 8,534,214 | B1 | 9/2013 | Gasper | |
| 8,539,897 | B1 | 9/2013 | Gasper et al. | |
| 8,578,873 | B2 | 11/2013 | Gasper et al. | |
| 8,739,723 | B1 * | 6/2014 | Murphy | B63B 1/34 114/125 |
| 9,260,161 | B2 | 2/2016 | Gasper et al. | |
| 9,315,236 | B2 | 4/2016 | Gasper | |
| 9,334,022 | B2 | 5/2016 | Gasper et al. | |
| 9,669,903 | B2 | 6/2017 | Gasper et al. | |
| 9,694,873 | B2 | 7/2017 | Gasper et al. | |
| 10,179,628 | B2 | 1/2019 | Gasper et al. | |

OTHER PUBLICATIONS

Montara Boats, Montara The Boat You Can Surf Behind, retrieved from website: https://www.montaraboats.com/ on Feb. 3, 2020, 13 pages.

Avalon Luxury Pontoon Boats, "Introducing the Avalon Waketoon", video retrieved from: https://www.avalonpontoons.com/pontoon-boat-models/waketoon/, video Published on Jan. 23, 2020, 3 pages.

* cited by examiner

RECREATIONAL WATERCRAFT WITH BALLAST SYSTEM

TECHNICAL FIELD

The present disclosure relates generally to recreational watercraft, and more particularly, to a recreational watercraft with ballast system.

BACKGROUND

Recreational watercraft represent a major portion of the boating industry. Potential users of recreational watercraft, however, may have various purposes for using them. Each of these various purposes may influence how a particular recreational watercraft is physically structured and how the potential user decides which recreational watercraft to purchase, rent, borrow, etc. One purpose includes providing transportation within and across waterways. A recreational watercraft used primarily for such transportation can include an engine to propel the watercraft and a deck surface to provide leisure and comfort for passengers. In addition to transportation, recent trends in popularity of water sports, such as wake surfing, wake boarding, and water skiing, have further altered the functionality and structure of recreational watercraft.

DETAILED DESCRIPTION

Figure 1A:
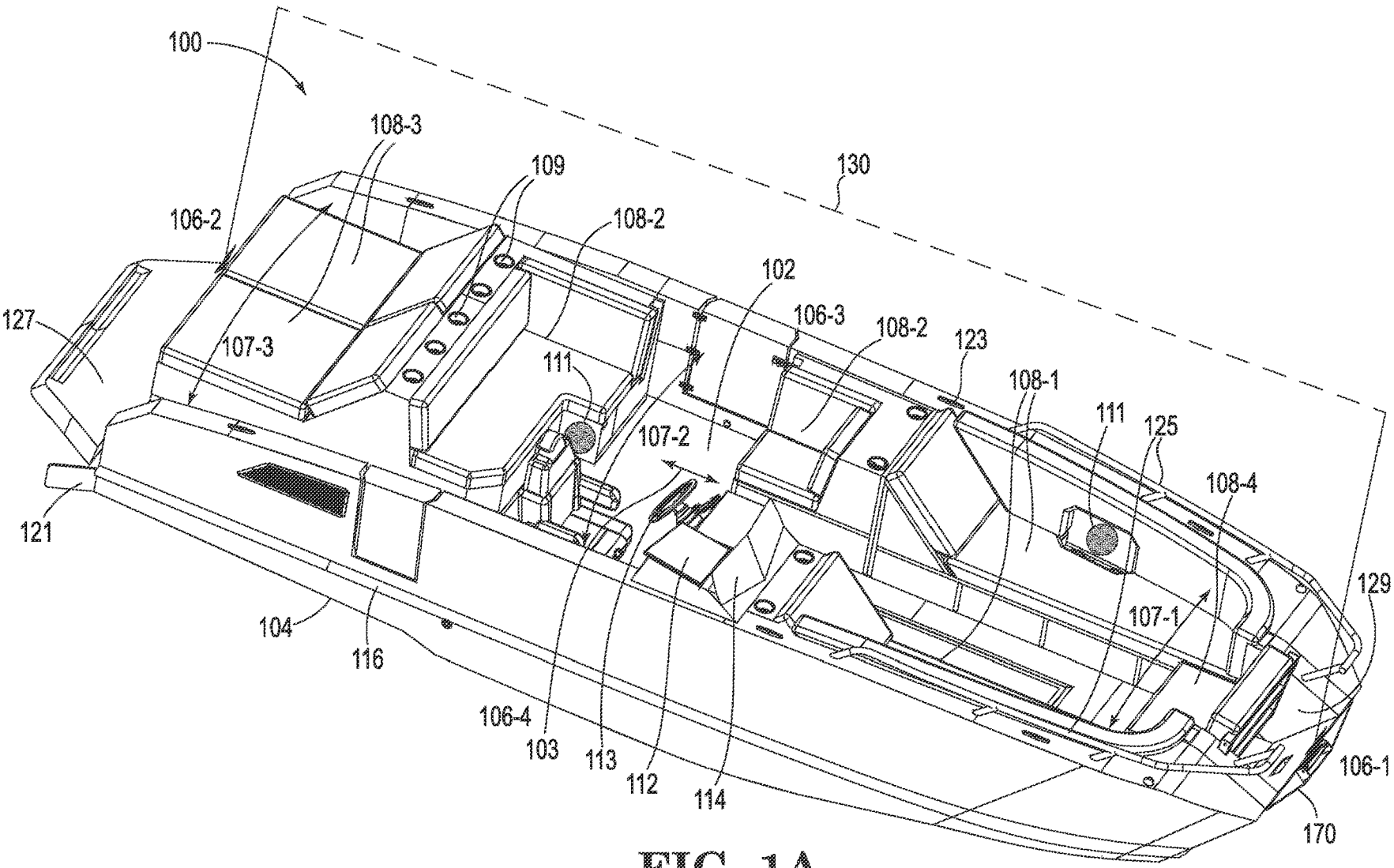
FIG. 1A illustrates a perspective view of a recreational watercraft in accordance with a number of embodiments in the present disclosure.

The present disclosure includes recreational watercraft, and more particularly, recreational watercraft configured having a panel drop down boarding point. In the following detailed description of the present disclosure, reference is made to the accompanying drawings that form a part hereof, and in which is shown by way of illustration how a number of embodiments of the disclosure can be practiced. These embodiments are described in sufficient detail to enable those of ordinary skill in the art to practice the embodiments of this disclosure, and it is to be understood that other embodiments can be utilized and that process, electrical, and structural changes can be made without departing from the scope of the present disclosure.

As used herein, designators such as "N," etc., particularly with respect to reference numerals in the drawings, indicate that a number of the particular feature so designation can be included. It is also to be understood that the terminology used herein is for the purpose of describing particular embodiments only and is not intended to be limiting. As used herein, the singular forms "a," "an," and "the" can include both singular and plural referents, unless the context clearly dictates otherwise. In addition, "a number of," "at least one," and "one or more" refer to one or more of a structure, whereas a "plurality of" is intended to refer to more than one of such things. Furthermore, the words "can" and "may" are used throughout this application in a permissive sense (i.e., having the potential to, being able to), not in a mandatory sense (i.e., must). The term "include," and derivations thereof, means "including, but not limited to."

The figures herein follow a numbering convention in which the first digit or digits correspond to the figure number and the remaining digits identify an element or component in the figure. Similar elements or components between different figures can be identified by the use of similar digits. For example, 106 can reference element "06" in FIG. 1, and a similar element can be referenced as 206 in FIG. 2. As will be appreciated, elements shown in the various embodiments herein can be added, exchanged, and/or eliminated so as to provide a number of additional embodiments of the present disclosure. In addition, the proportion and/or the relative scale of the elements provided in the figures are intended to illustrate certain embodiments of the present disclosure and should not be taken in a limiting sense.

FIG. 1A illustrates a perspective view of a recreational watercraft in accordance with a number of embodiments in the present disclosure. As shown in FIG. 1A, recreational watercraft 100 is disclosed having an open platform passenger deck 102. As used herein, the language/terms "open platform passenger deck" is intended to mean a platform deck allowing continuous passage from bow to stern for passengers of the watercraft along a planar floor surface. In some embodiments, both bow and stern have a minimum interior width of ninety-six inches (96" or eight feet (8')) between sidewalls to the hull at the bow and stern. In at least one embodiment, the language/term "open platform passenger deck" 102, as used herein, is intended to mean ingress and egress boarding points purposefully formed through (e.g., without climbing over) the sidewalls and/or rails to the recreational watercraft 100 are located at both the bow and stern portions of the recreational watercraft 100 and are provided as part of the open platform passenger deck meaning.

According to various embodiments, the recreational watercraft 100 includes a single hull 104 (e.g., single v-hull or other unitary geometry shaped hull) located at the bottom of the recreational watercraft 100 to provide structural integrity and buoyancy for the recreational watercraft 100. In one or more embodiments, the single hull 104 may be fabricated from metal or a composition alloy of metal. In at least one embodiment, the single hull is an aluminum metal v-hull. For ease of illustration in the present disclosure, reference may be made to an aluminum hull as the single hull 104. Advantages of using an aluminum metal single hull 104 over other materials such as fiberglass include providing proper structural integrity to support the luxury of having a spacious open layout in the open platform passenger deck 102 and other functional features to the recreational watercraft 100 such as a panel drop down boarding point 170, as will be further described herein. For example, by contrast, many recreational or inboard water-sports boats are formed using fiberglass hulls made from hull molds. Such watercraft are designed and fabricated for their sleek lines, turning agility, drag coefficients, and speed performance and responsiveness. Typically, the frame of such watercraft are assembled from multiple molds and then the fiberglass joined together at different sections (e.g., base hull mold joined to multi-stepped deck platform molds and separate rail cap molds for the watercraft). Such a construction approach does not allow for the open platform passenger deck 102 and other functional features to the recreational watercraft 100 such as the panel drop down boarding point 170, as will be further describe herein. Embodiments, however, are not intended to be limited to any single hull example given herein and other single hull 104 geometries and/or materials are intended to be covered by embodiments disclosed herein.

The single hull 104 further includes a ballast system (e.g., an enclosed, interior ballast system to the single hull 104 as shown and described in connection with FIG. 2A and elsewhere herein) comprising a plurality of ballast apparatuses that allows for regulating water displacement of the watercraft through using a plurality of ballast tanks, each having a plurality of openings and a valve configured to selectively close and open one opening of the plurality of openings for each ballast tank. The single hull 104 further comprises an inboard power plant (e.g., an enclosed, fully interior inboard motor as shown and described in connection with FIGS. 2A and 2B and elsewhere herein) located within a stern portion of the single hull 104 to propel the recreational watercraft 100.

The recreational watercraft 100 can further comprise of a plurality of sides that extend continuously from the single hull 104. In aluminum metal single hull 104 embodiments, the plurality of sides that extend continuously from the single hull 104 can also be constructed of aluminum. The plurality of sides may form a bow side 106-1, a stern side 106-2, a port side 106-3, and a starboard side 106-4 that surround and enclose a perimeter of an upper surface of the open platform passenger deck 102 of the recreational watercraft 100. In some embodiments, the interior of the recreational watercraft 100 on the bow side 106-1 portion may be enclosed by the plurality of sides in a rectangular orientation. As used herein, a rectangular orientation may refer to a rectangular orientation (e.g., having a rounded corner near the port side 106-3 and near the starboard side 106-4), an elongated oblong shape, and/or other examples where neither the internal nor external walls on the bow side 106-1 meet at a fixed apex.

As noted, the bow side 106-1 can include an opening 129 in a side of the single hull 104, where a portion of an interior surface of a panel drop down boarding point 170 (discussed further below) may overlap the bow side 106-1 and cover the opening 129 when in the closed position. The panel drop down boarding point 170 may be hingedly attached horizontally to the single hull 104, for ingress and egress of persons to the recreational watercraft (e.g., as shown and described in connection with FIG. 7A and elsewhere herein) that is movable to alternate between an open position and a closed position by operation of one or more telescopic pistons that may be controlled by a user, for example, from a control console 112.

In some embodiments, the panel drop down boarding point 170 may be located on the bow side 106-1 of the recreational watercraft 100, however embodiments are not so limited. For example, the panel drop down boarding point 170 may alternatively, be singularly located on either the stern side 106-2, port side 106-3 or starboard side 106-4. Further, a plurality of panel drop down boarding points 170 may be located on more than one of the plurality of sides, such that multiple panel drop down boarding points 170 may be located on varying sides at the same time (e.g., a panel drop down boarding point located at the bow side 106-1 and another panel drop down boarding point located at the stern side 106-2). For example, although not shown in the figures herein, panel drop down boarding points may be located on two sides, three sides, or all four sides of the plurality of sides of the recreational watercraft 100 where each side of the plurality of sides may incorporate one or more panel drop down boarding points.

In some embodiments, the plurality of sides may include a number of cleats 123 on an upper surface of the plurality of sides to provide a fitting structure (e.g., docking line or other line may be fastened). Further, the upper surface of the plurality of sides may also include railing structures 125 located from the bow side 106-1 that extend toward the stern side 106-2 to provide a handrail for users when on or entering the recreational watercraft 100. In further embodiments, an exterior surface of the plurality of sides may include a rub rail 116 that extends from the bow side 106-1 to the stern side 106-2 along a length of the recreational watercraft 100 to provide protection of the exterior surface of the recreational watercraft 100 from abrasions from docks, wharfs, pilings, rocks, other watercrafts, among other potential hazards.

In some embodiments, the stern side 106-2 of the recreational watercraft 100 may have a swim platform 127 that may either be integral or removably coupled to the stern side 106-2. The swim platform 127 may provide a drop down mechanism that enables it to alternate between an open and closed position. Further, when open, the swim platform 127 may be parallel in relation to the plane of the open platform passenger deck 102 and, when closed, the swim platform 127 may be perpendicular to the open platform passenger deck, although examples are not so limited. For example, the swim platform may be angled downward or upward in relation to the plane of the open platform passenger deck 102 and when in the downward angle, will have its surface at least partially beneath a waterline (as shown at 115 in FIG. 1B). Further, the swim platform 127 may have a non-slip coating or patterned surface. In some embodiments, recreational watercraft 100 may further include a plurality of wake shaping devices 121 affixed to the stern side 106-2 portion of the port side 106-3 and starboard side 106-4, as will be further described in FIG. 2A.

Recreational watercraft 100 further includes the open platform passenger deck 102 that acts as an integral upper surface to the aluminum hull 104 wherein the perimeter of the open platform passenger deck 102 is surrounded by the plurality of sides 106-N. The recreational watercraft 100 may further comprise an external length (not shown in FIG. 1A) ranging from 18'-32' when a swim platform 127 and the panel drop down boarding point 170 are in a closed position. For example, the recreational watercraft 100 in this embodiment may comprise an external length of 21', 23', or 25', among other lengths.

The interior length 130 of the open platform passenger deck 102 may be longer or shorter depending on the respective external length. For example, a 23' external length recreational watercraft 100, may comprise an open platform passenger deck 102 comprising an internal length ranging from 270"-302" with the upper range being achieved when both the drop down boarding point 170 and swim platform 127 are in the open position. In a 21' external length embodiment of the recreational watercraft 100, the interior length 130 of the open platform passenger deck 102 may range from 246"-278". In a 25' external length embodiment of the recreational watercraft 100, the interior length 130 of the open platform passenger deck 102 may range from 294"-326". While these lengths are defined, they are not so limited and in further embodiments, similar ratios and measurements of an internal length 130 of the open platform passenger deck 102 to the external length of the recreational watercraft 100 may be employed.

As described above, the open platform passenger deck 102 may include the surfaces of the drop down boarding point 170 and swim platform 127 when in an open position. Advantages of employing an open platform passenger deck 102 such as this include ease of ingress and egress of a user to and from the recreational watercraft 100 from the water, land, dock, and among other user locations. For example, the ease of ingress of a user from the water to the recreational watercraft 100 provided by more access points by the drop down boarding point 170 and swim platform 127 may provide for greater safety by allowing a fatigued swimmer to board more easily. In yet another example, the open platform passenger deck 102 may further provide for ease of ingress and egress for disabled users (e.g., wheelchair access points).

The recreational watercraft 100, regardless of its external length, may further comprise a maximum external width between the external surfaces of the port side 106-3 and the starboard side 106-4 ranging between 90" and 102" to allow the recreational watercraft 100 to be stored on a towing platform, garage, docking area, among other locations. The open platform passenger deck 102, regardless of external length, further comprises an interior bow width 107-1 ranging from around 50" to around 84", an interior stern width 107-3 ranging from around 70" to around 90", and a maximum interior width 107-2 ranging from around 70" to around 90". The open platform passenger deck 102 may have these widths to facilitate an open layout for a user to maneuver throughout the open platform passenger deck 102. As used herein, open layout refers to a continuous structurally unimpeded walkway 103 from the stern side 106-2 of the open platform passenger deck 102 to the bow side 106-1 of the open platform passenger deck 102. As used herein, continuous structurally unimpeded walkway 103 refers to a platform wherein a user is able to freely traverse the plane of the open platform passenger deck 102 from the stern side 106-2 to the bow side 106-1 and/or from the port side 106-3 to the starboard side 106-4 without the need to remove any structures (e.g., a removable windshield, an internal gate, collapsible wall, among other barriers), without having to pass through any enclosed cabins or structuresk, and without the need to physically traverse over any such structures.

The open platform passenger deck 102 has an open layout comprising a control console 112 responsible for controlling various mechanisms and features of the recreational watercraft 100, as will be further described herein. The control console 112 may be located along the starboard side 106-4 and in between the bow side 106-1 and stern side 106-2. In some embodiments, the control console 112 may be located instead along the port side 106-3. The control console 112 may further include control elements, where the control elements may be buttons, levers, switches, and/or display elements (e.g., icons) of a displayed interface (e.g., a touch screen, monitor, etc.). A user may physically interact with the control elements to control various mechanisms. In other examples, the control console 112 may control the various mechanisms independently from user control. Such examples may include having a timer sequence of the control console 112 that is responsive to a desired specific time or desired passing of an amount of time, and in response to the desired time or desired amount of passed time being met, the control console 112 may control the various mechanisms. Other examples may employ a sensor system to detect either physical structures, users, water level or depth, among other examples, and in response to the sensor system detecting the respective stimuli, the control console 112 may control the various mechanisms.

The control console 112 may be associated with or include a steering mechanism 113 facing the stern side 106-2 to allow a user to control direction of the recreational watercraft 100 and may include control elements to control various mechanisms of the recreational watercraft 100. Examples of a steering mechanism 113 include but are not limited by: a rotating steering wheel, a pivotable control stick, or a plurality or combination of both. In some embodiments, the steering mechanism 113 may be controlled mechanically (e.g., by a user) or electronically (e.g., via a GPS system, sensor system, voice activated system, etc.) The steering mechanism 113 may be adjustable longitudinally, vertically, or a combination thereof and may be adjusted either electrically from the control console 112 or physically through an adjustment mechanism to be used by a user, such as a lever, latch, screw, or rotational mechanism. In some embodiments, the steering mechanism 113 may be removable or may be retracted to be flush with the control console when not in use.

The control console 112 may include a windshield 114 affixed to the top of the control console 112 to prevent wind, water, and/or debris from reaching the user when driving the recreational watercraft 100. The windshield 114 may span across only a portion of the maximum width 107-2 of the recreational watercraft 100 in order to facilitate the longitudinal open layout of the continuous unimpeded walkway of the open platform passenger deck 102. That is, the windshield 114 does not encumber or block the open platform passenger deck 102 from having a continuous structurally unimpeded walkway from the stern side 106-2 to the bow side 106-1. In some embodiments, the windshield 114 may be formed from of glass, plexiglass, plastic, tinted material, fiberglass, and/or metal. The windshield 114 may contain wiper blades (not shown) to remove water and debris from the exterior of the windshield 114. Further, the windshield 114 may be removable either physically by a user and/or electrically through retracting back into the control console 112 when not in use.

The control console 112 may control the opening and closing of the panel drop down boarding point 170. In some embodiments, a first control element may be configured to control operation of extending the retractable pistons, thereby opening the panel drop down boarding point 170, and a second control element may be configured to control operation of retracting the retractable pistons thereby, closing the panel drop down boarding point 170. In some embodiments, such controls may be located near the panel drop down boarding point 170, such as on the bow side 106-1 or port side 106-3, etc.

In other embodiments, the control console 112 may further control the ballast system described herein. In some embodiments, a series of control elements can be configured to control operation of the ingress and egress of water to and from each ballast tank of the ballast system, either together or independently, as will be described further herein. In some embodiments, each ballast tank may allow pump-less ingress and egress of water.

The open platform passenger deck 102 includes an open layout comprising a plurality of seats from the bow side 106-1 to the stern side 106-2. The plurality of seats may, in various embodiments, include a plurality of elongated seats 108-1 at the bow side 106-1 of the recreational watercraft 100, for example, to allow sufficient room for a user to lay comfortably across with their legs up on the elongated seats 108-1, among other benefits. The plurality of seats may further include a plurality of non-elongated seats 108-2 between the bow side 106-1 and stern side 106-2 of the recreational watercraft 100. The non-elongated seats 108-2 may provide more upright seating and may be of an L-shape, square shape, among other examples.

Further, the plurality of seats may include a number of partially elongated seats 108-3 at the stern side 106-2 that allow for seating of users to overlook the water at the stern side. The partially elongated seating 108-3 may further serve as a power hatch to access the inboard power plant within the aluminum hull 104. That is, the partially elongated seating 108-3 may be opened and/or closed either by the control console 112 or physically by a user via a drop down or flip up mechanism. In some embodiments, the plurality of seats may optionally comprise a removable seat 108-4 that may be removably coupled to the bow side 106-1, stern side 106-2, port side 106-3, and/or the starboard side 106-4. The removable seat 108-4 may be removably coupled through various mechanisms such as latching, magnetic, slide and lock, or wedge fit, among other examples. As described herein, the removable seat 108-4 may be optionally employed to the recreational watercraft 100 and when discussing the open layout of the open platform passenger deck 102, it is to be understood that the removable seat 108-4 is not coupled to the bow side 106-1. The open platform passenger deck 102 may include one or more charging ports, power supply outlets, lights (e.g., light-emitting diodes (LEDs), red, green, blue (RGB) LEDs, etc.), cameras, heated seats, and/or heaters. In some embodiments, the open platform passenger deck 102 may include a plurality of cylindrical holders 109 located from the bow side 106-1 to the stern side 106-2 to provide housing for beverages, keys, wallets, and other user items. Further, the cylindrical holders 109 may allow for a cooling mechanism to keep a user's beverage cold or a heating mechanism to keep a user's beverage hot. In further embodiments, the open platform passenger deck 102 may further comprise a plurality of audio systems 111 located throughout the bow side 106-1 to the stern side 106-2 to provide audio output either wirelessly (e.g., via Bluetooth) or from a user device to be connected to the control console 112. The plurality of audio systems 111 may be further located in an interior surface of the plurality of sides, an exterior surface of the plurality of sides, a surface beneath the plurality of seats, where the plurality of audio systems 111 may further be recessed in the respective surfaces.

Figure 1B:
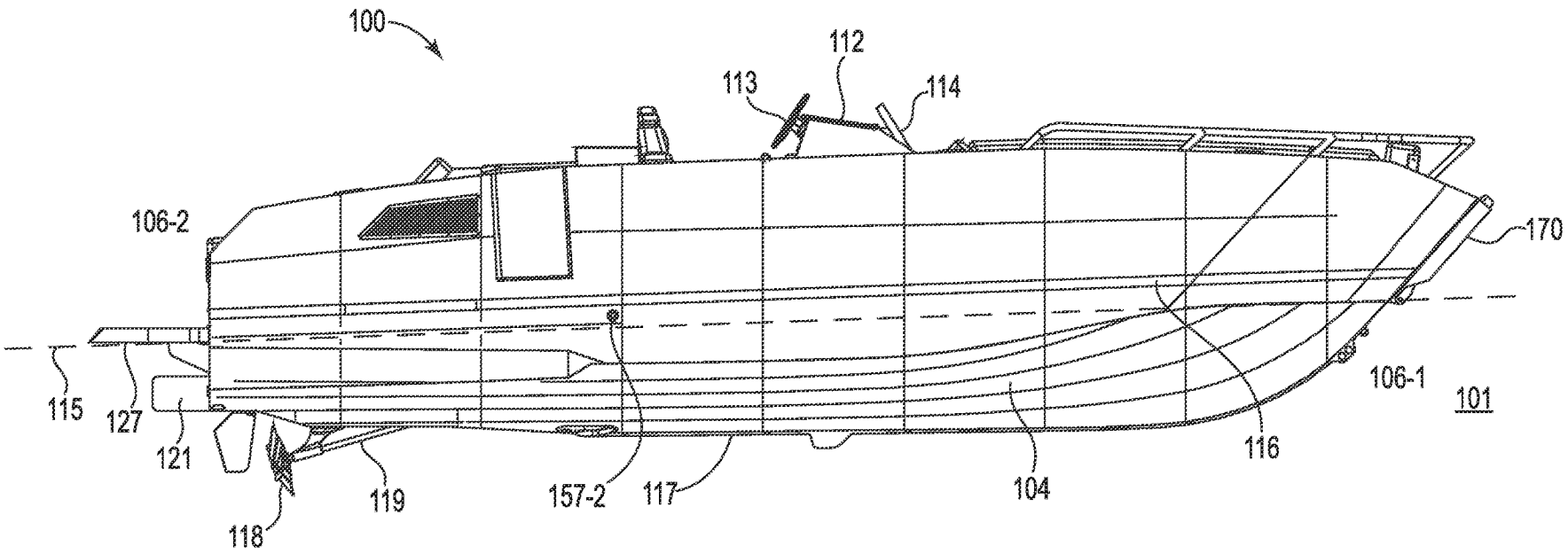
FIG. 1B illustrates a sideview of a recreational watercraft displacing water to create a waterline in accordance with a number of embodiments of the present disclosure.

FIG. 1B illustrates a sideview of a recreational watercraft displacing water to create a waterline in accordance with a number of embodiments of the present disclosure. The recreational watercraft 100 displaces water beneath the recreational watercraft 100 to create a waterline 115 that is relative to the recreational watercraft 100 and a body of water 101.

The recreational watercraft 100 may comprise all of the aforementioned features in FIG. 1A, such as the control console 112, steering mechanism 113, windshield 114, a bow side 106-1, a stern side 106-2, a drop down panel boarding point 170, etc. FIG. 1B further illustrates a bottom 117 and waterline 115 of the aluminum hull 104, through which a continuous planar drive shaft 119 may extend from an inboard power plant (220 in FIG. 2B) to a propeller 118 through the aluminum hull 104 at an angle ranging from 5-30 degrees relative to the bottom 117 of the recreational watercraft 100.

In some embodiments, the continuous planar drive shaft 119 extends from an inboard power plant (220 in FIG. 2B) to a propeller 118 through the aluminum hull 104 at an angle ranging from 10-20 degrees relative to the bottom 117 of the recreational watercraft 100. Although the continuous planar drive shaft 119 is shown and described as extending through the bottom 117 of the recreational watercraft 100, other examples may allow for the continuous planar drive shaft 119 to extend out the stern side 106-2 of the single hull 104.

Figure 2A:
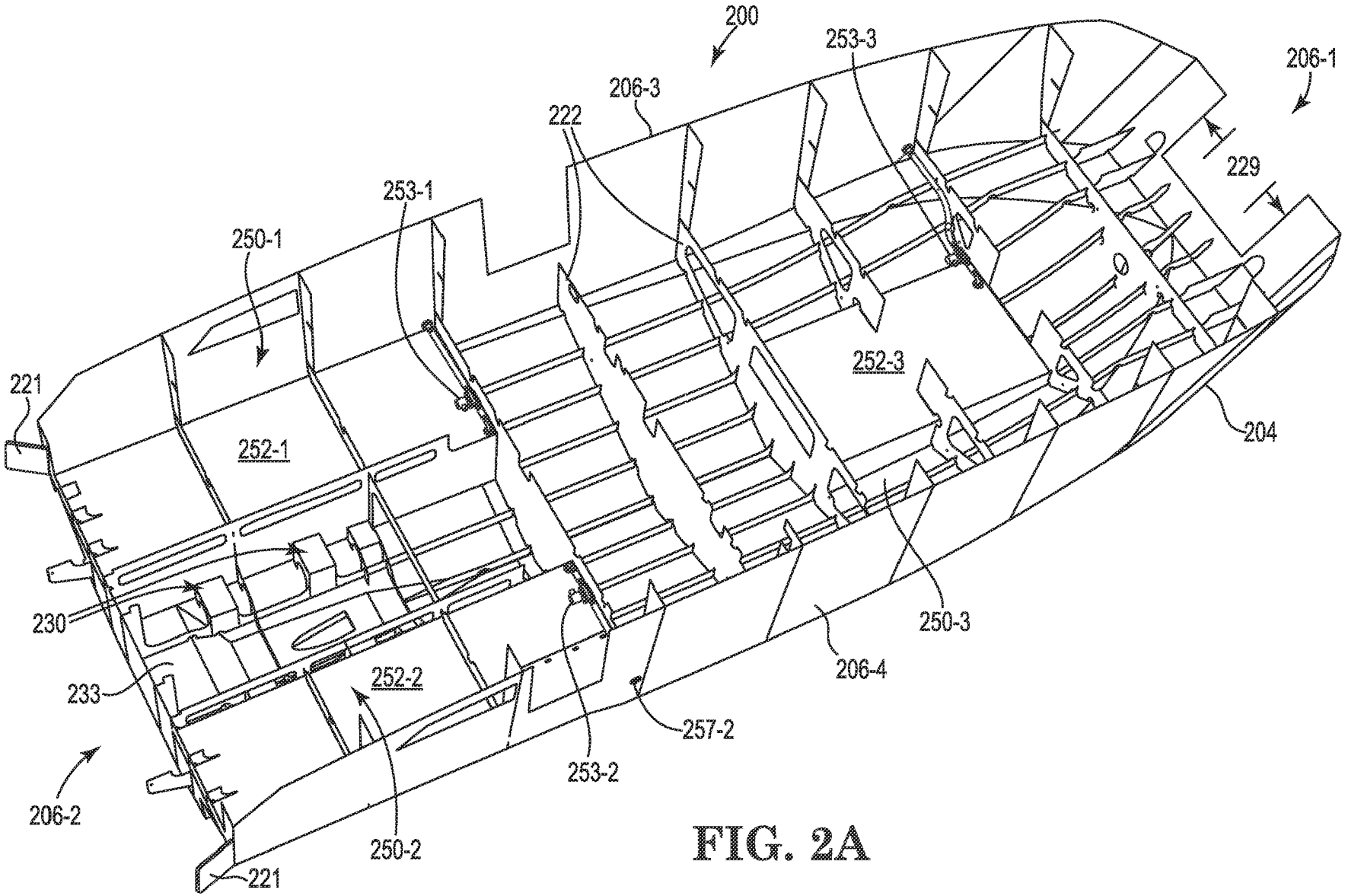
FIG. 2A illustrates a horizontal cross-sectional perspective view of a recreational watercraft that provides an internal view of a hull in accordance with a number of embodiments of the present disclosure.

FIG. 2A illustrates a horizontal cross-sectional perspective view of a recreational watercraft that provides an internal view of a single hull in accordance with a number of embodiments of the present disclosure. The single hull 204 further comprises a plurality of sides 206 continuously formed to the single hull 204.

In the embodiment of a single aluminum hull 204, the plurality of sides 206 may be fabricated from aluminum continuous from the aluminum hull 204. For example, a bow side 206-1, stern side 206-2, port side 206-3, and a starboard side 206-4 of the plurality of sides (collectively referred to as "plurality of sides 206") are continuous from the aluminum hull 204. That is, the plurality of sides 206 extend directly from the aluminum hull 204 such that the aluminum hull 204 and plurality of sides are bent, folded, and/or welded together, to form a single cohesive skeleton upon which to house the open platform passenger deck (102 in FIG. 1A) as described above and elsewhere herein. In other words, the plurality of sides and the aluminum hull 204 may be viewed as a single continuous structure to provide structural support for an open platform passenger deck (102), as described in FIG. 1A.

In the aluminum hull 204 embodiment, the recreational watercraft 200 further comprises a plurality of cross members 222 within the aluminum hull 204 to provide structural support for the aluminum hull 204 (e.g., instead of using an internal fiberglass liner for the structural support). The plurality of cross members 222 may further provide support for the open platform passenger deck 102. That is, in some embodiments, the open platform passenger deck 102 is placed on and affixed to a top surface of the cross members 222 (e.g., via welding, gluing, bolting, among other attachment mechanisms). FIG. 2A also includes a space 229 for the placement of a panel drop down boarding point on the bow side 206-1. The panel drop down boarding point is shown in this location at 270 of FIG. 2B and in FIG. 2C.

As shown in FIG. 2A, the watercraft 200 further comprises an integrated ballast system enclosed within the single hull 204 comprising a plurality of ballast apparatuses. For example, the watercraft 200 can include a first ballast apparatus 250-1, a second ballast apparatus 250-2, and a third ballast apparatus 250-3 (sometimes cumulatively referred to as "ballast apparatuses 250"). In wake sports and/or towed water sports (e.g., wake boarding, wake surfing, water skiing, etc.), it may be desirable to increase or decrease the volume of water displaced—and thus the wake created—by the watercraft 200. Taking on or releasing ballast can regulate the water displaced by the watercraft 200 which changes the wave shape created as the watercraft moves through the water (101 in FIG. 1B).

In some embodiments, the watercraft 200 can include three ballast apparatuses 250, however, more or less apparatuses can be used. In some embodiments, two of the ballast apparatuses 250 can be located toward a stern 206-2 of the watercraft 200 (e.g., in a back half of the watercraft 200) and one of the ballast apparatuses 250 can be located towards a bow 206-1 of the watercraft 200 (e.g., in a front half of the watercraft 200), though embodiments herein are not so limited.

As described further herein, a ballast apparatus 250 can include a ballast tank 252 having a plurality of openings and a valve 253 configured to selectively close and/or open a top one of the openings. For instance, as described below in connection with FIG. 3, a first ballast apparatus 250-1 can include a valve 253-1 and a first ballast tank 252-1 having a top opening (559 in FIG. 5) connected through valve 253-1 to a hull side opening (457-1 in FIG. 4), and a bottom opening (562 in FIG. 5) to an exterior of a bottom surface of the hull (117 in FIG. 1B). A second ballast apparatus 250-2 can include a valve 253-2 and a second ballast tank 252-2 having a top opening (559 in FIG. 5) connected through valve 253-2 to a hull side opening 257-2, and a bottom opening (562 in FIG. 5) to an exterior of a bottom surface of the hull (117 in FIG. 1B). A third ballast apparatus 250-3 can include a valve 253-3 and a third ballast tank 252-3 having a top opening (559 in FIG. 5) connected through valve 253-3 to a hull side opening (457-3 in FIG. 4), and a bottom opening (562 in FIG. 5) to an exterior of a bottom surface of the hull (117 in FIG. 1B). As shown, the first ballast tank 252-1 can be located on a port side 206-3 of the watercraft 200, the second ballast tank 252-2 can be located on a starboard 206-4 side of the watercraft 200, and the third ballast tank 252-3 can be located on a centerline of the watercraft, though embodiments herein are not so limited.

Control of the ballast apparatuses 250 can be provided via a control console (e.g., the control console 112 previously described in connection with FIGS. 1A and 1B). The control console can include a plurality of control elements. The control elements allow for (e.g., facilitate) control of the valve(s) 253 of the ballast apparatus(es) 250. The control elements can be buttons, levers, switches, and/or display elements (e.g., icons) of a displayed interface, for instance. In some embodiments, a first control element can be configured to control operation of the first ballast apparatus 250-1, a second control element can be configured to control operation of the second ballast apparatus 250-2, and a third control element can be configured to control operation of the third ballast apparatus 250-3. In some embodiments, a fourth control element can be configured to control operation of the first ballast apparatus 250-1, the second ballast apparatus 250-2, and the third ballast apparatus 250-3 (e.g., global control of all the ballast apparatuses 250 of the watercraft 200).

To enable performance of wake sports and towed watersports, a sufficient wake may be created behind the recreational watercraft 200. This may be achieved by adjustably filling one or more of the ballast tanks of the ballast apparatuses 250 with water, to regulate water displacement in the body of water (101 in FIG. 1B) beneath the recreational watercraft 200, beneath the waterline 115 (as shown in FIGS. 1A and 1B) while the recreational watercraft 200 is propelled by the inboard power plant (220 in FIG. 2B). In some embodiments, recreational watercraft 200 may include a plurality of wake shaping devices 221 affixed to the stern side 206-2 portion of the port side 206-3 and starboard side 206-4 to further alter the shape and size of the wake when dragged partially or wholly beneath the waterline 115. The wake shaping devices 221 may be integral or removably coupled to the sides of the recreational watercraft 200. Further wake shaping devices 221 may be movable in a flap, pivoting, rotational, etc. mechanism either physically actuated by a user or electronically through the control console described in FIGS. 1A and 1B.

In various embodiments, the aluminum hull 204 may have the inboard power plant (220 in FIG. 2B) affixed in the aluminum hull 204 within a power plant bay 233. The power plant bay 233 may be located between the two stern-located ballast tanks 250-1 and 250-2 and along a centerline of the aluminum hull 204. For example, the inboard power plant (220 in FIG. 2B) may be installed on a number of landing points 230 of the power plant bay 233 by bolts, adhesives, among other fastening methods.

Figure 2B:
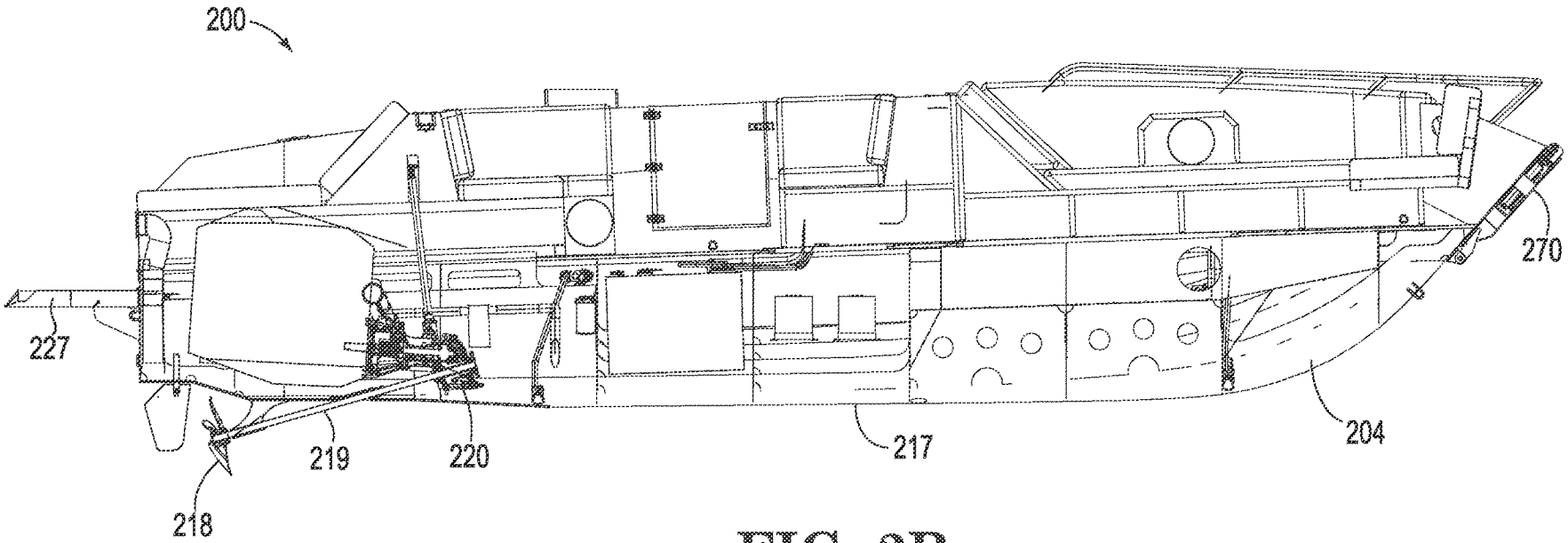
FIG. 2B illustrates a vertical cross-sectional side view of a recreational watercraft that provides an internal view of a hull in accordance with a number of embodiments of the present disclosure.

FIG. 2B illustrates a vertical cross-sectional side view of a recreational watercraft 200 that provides an internal view of a hull 204 in accordance with a number of embodiments of the present disclosure. The recreational watercraft 200 may be analogous to the recreational watercraft 100 and comprises an inboard power plant 220 located wholly within the interior portion of the aluminum hull 204. That is, the inboard power plant 220 is entirely within the aluminum hull 204 and includes a continuous planar drive shaft 219. For example, the wholly inboard power plant 220 comprises a continuous planar drive shaft 219 that may extend to a propeller 218 exterior to the hull 209. The continuous planar drive shaft 219 may extend to the propeller 218 at an angle ranging from 10 to 20 degrees relative to a bottom 217 of the recreational watercraft 200. Embodiments, however, are not limited to this example.

In some embodiments, the inboard power plant 220 may be an internal combustion gas or diesel engine, an electric engine, or a jet propulsion mechanism, among other examples of propulsion powering to provide sufficient towing power to pull a user in the water behind the recreational watercraft 200. For this, the inboard power plant 220 may be selected to have sufficient horsepower to enable performance of wake sports and towed watersports. In various embodiments the inboard power plant 220 has horsepower output capability in a range from 400 horsepower to 1000 horsepower, or similar equivalent. Although not illustrated, the recreational watercraft 200 may include additional propulsion devices, for example, one or more thrusters located at the stern 206-2 and/or bow 206-1 of the recreational watercraft 200 to increase maneuverability of the recreational watercraft 200.

Figure 2C:
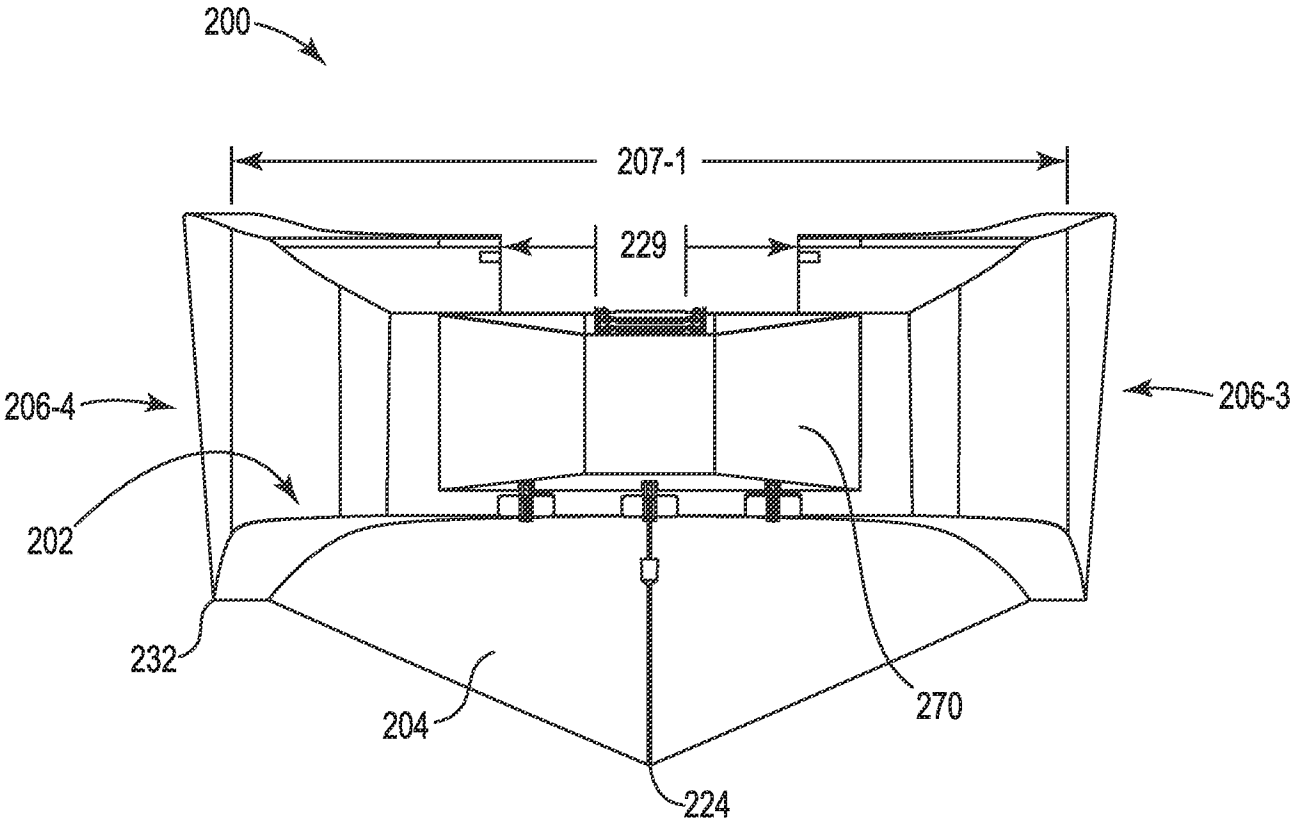
FIG. 2C illustrates a front view that provides a view of port and starboard sides of an open platform passenger deck in relation to a hull of a recreational watercraft in accordance with a number of embodiments of the present disclosure.

FIG. 2C illustrates a front view, bounded by port 206-3 and starboard 206-4 sides, that provides a front perspective of the open platform passenger deck 202 (as described above) in relation to a hull 204 of a recreational watercraft 200 in accordance with a number of embodiments of the present disclosure. As mentioned above, the open platform passenger deck 202 has a bow width 207-1 which is substantially equivalent in width to a stern width (e.g., 107-3 in FIG. 1A) of the recreational watercraft 200. In some embodiments, an interior width 207-1 to the bow portion of the open platform passenger deck 202 is at least eighty-four inches (84") wide (e.g., seven feet (7') wide). In some embodiments, recreational watercraft 200 may have an aluminum hull 204 and a keel 224 located at the bottom of the aluminum hull 204 and along a centerline longitudinally of the length of the aluminum hull 204. The aluminum hull 204 may be an aluminum v-shaped hull fabricated and/or formed with the sides 206 of the aluminum hull 204 meeting at the chines 232 and at the keel 224 of the recreational watercraft 200. That is, the aluminum hull 204 may form a v-shape through having its sides come to a point at the keel 224.

Figure 3:
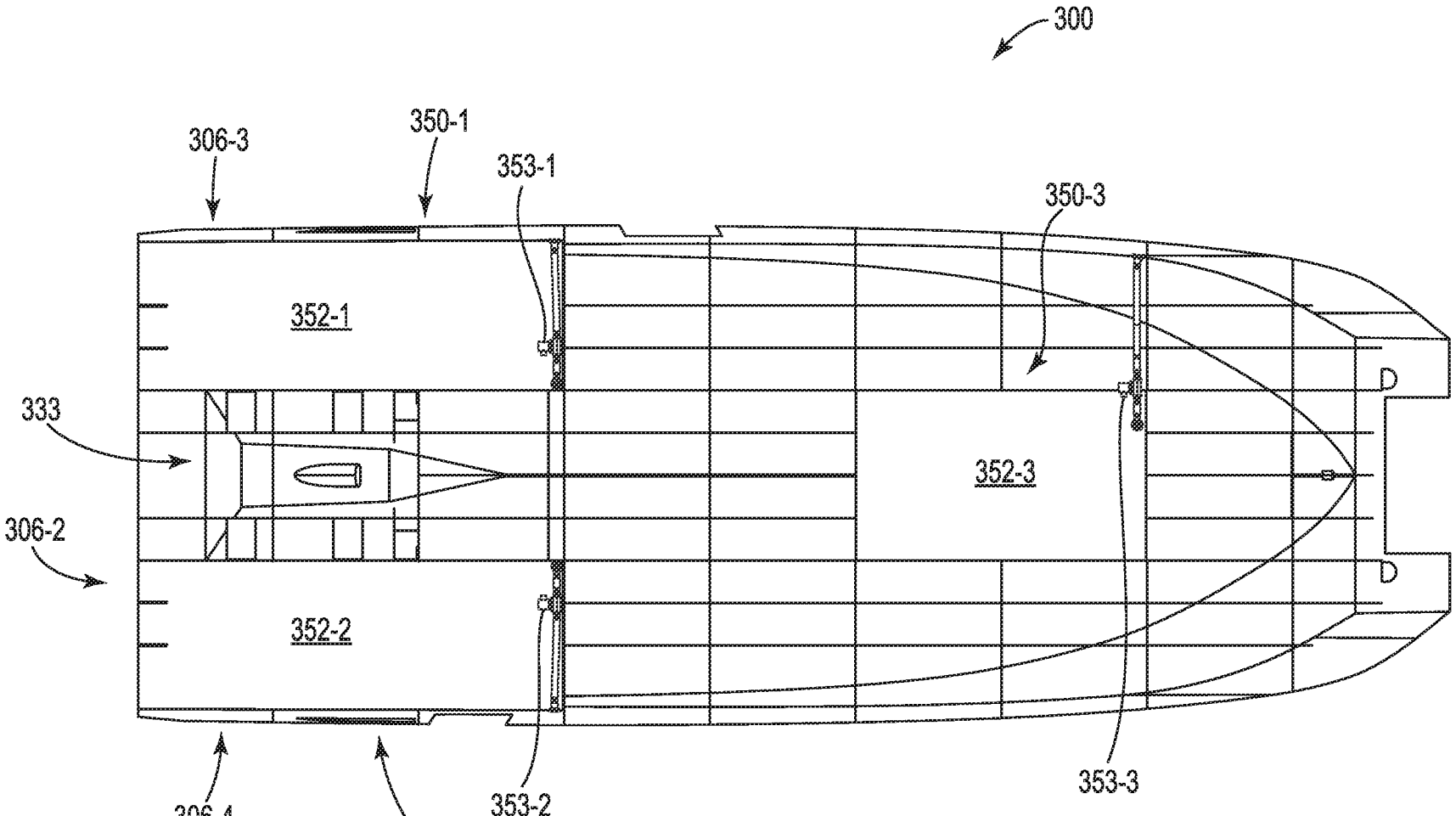
FIG. 3 illustrates a horizontal cross-sectional top view of a recreational watercraft in accordance with one or more embodiments of the present disclosure.

FIG. 3 illustrates a horizontal cross-sectional top view of a recreational watercraft 300 in accordance with a number of embodiments of the present disclosure. As previously discussed, and as shown in FIG. 3, the watercraft 300 can include a plurality of ballast apparatuses 350. In some embodiments, the watercraft 300 can include three ballast apparatuses 350, though it is noted that the present disclosure is not so limited. For instance, the watercraft 300 illustrated in FIG. 3 includes a first ballast apparatus 350-1, a second ballast apparatus 350-2, and a third ballast apparatus 350-3 (cumulatively referred to as "ballast apparatuses 350").

As described herein, a ballast apparatus (e.g., the ballast apparatus 350-1) can include a ballast tank (e.g., ballast tank 352-1) having a plurality of openings and a valve (e.g., valve 353-1) configured to selectively close and/or open one of the openings. Three ballast tanks are illustrated 352-1, 352-2, and 352-3 (collectively referred to as "ballast tanks 352"), at least one to each of the ballast apparatuses 350, respectively. Similarly, three valves are illustrated 353-1, 353-2, and 353-3 (cumulatively referred to as "valves 353"), at least one to each of the ballast apparatuses 350, respectively. Embodiments, however, are not limited to this example number of ballast tanks 352 or valves 353 for the ballast apparatuses 350. The ballast tanks 352 and the valves 353 in accordance with the present disclosure are discussed in more detail below in connection with FIGS. 5 and 6. As shown in FIG. 3, a first ballast apparatus 350-1 can include a first valve 353-1 associated with a first ballast tank 352-1, a second ballast apparatus 350-2 can include a second valve 353-2 associated with a second ballast tank 352-2, and a third ballast apparatus 350-3 can include a third valve 353-3 and a third ballast tank 352-3.

In some embodiments, the ballast tanks 352 can all be a same size. In other embodiments, one or more ballast tanks 352 can be of different sizes. In some embodiments, the first ballast tank 352-1 and the second ballast tank 352-2 can be a same size and the third ballast tank 352-3 can be a different size. In some embodiments, ballast tanks 352 in accordance with the present disclosure have a volume in a range between 10 and 30 cubic feet. In some embodiments, ballast tanks 352 in accordance with the present disclosure have a volume in a range between 10 and 50 cubic feet. In some embodiments, ballast tanks 352 in accordance with the present disclosure have a volume between 5 and 100 cubic feet.

Figure 4:
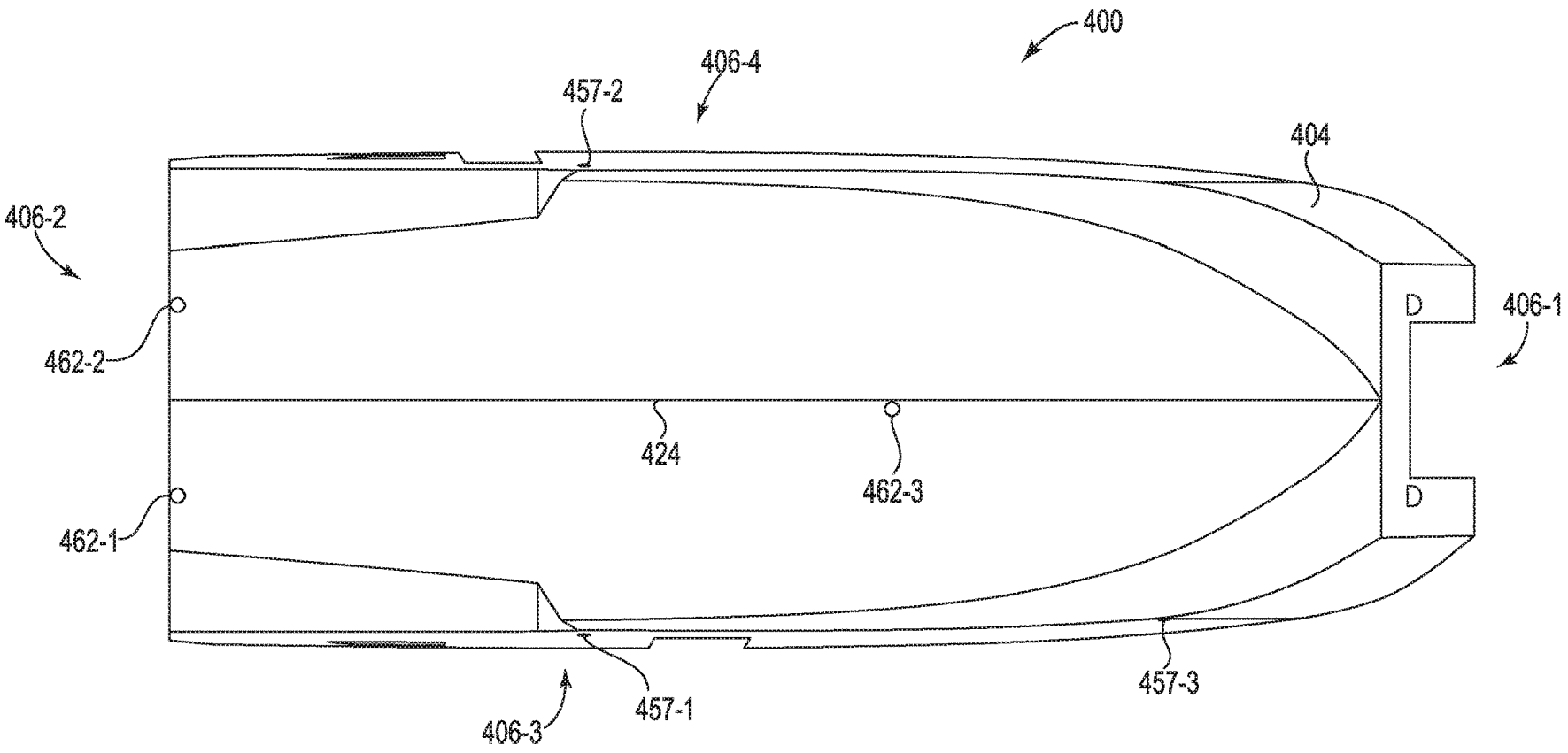
FIG. 4 illustrates a bottom view of a recreational watercraft in accordance with one or more embodiments of the present disclosure.

FIG. 4 illustrates a bottom view of a recreational watercraft 400 in accordance with a number of embodiments of the present disclosure. As described herein, a ballast apparatus in accordance with the present disclosure can include a ballast tank having a top opening and a bottom opening. Shown on the bottom portion of the hull in FIG. 4 are three such bottom openings: a first bottom opening 462-1 on the port side 406-3 of the stern end 406-2 of the watercraft 400, a second bottom opening 462-2 on the starboard side 406-4 of the stern end 406-2 watercraft 400, and a third bottom opening 462-3 towards the bow 406-1 of the watercraft 400 near the centerline.

Figure 5:
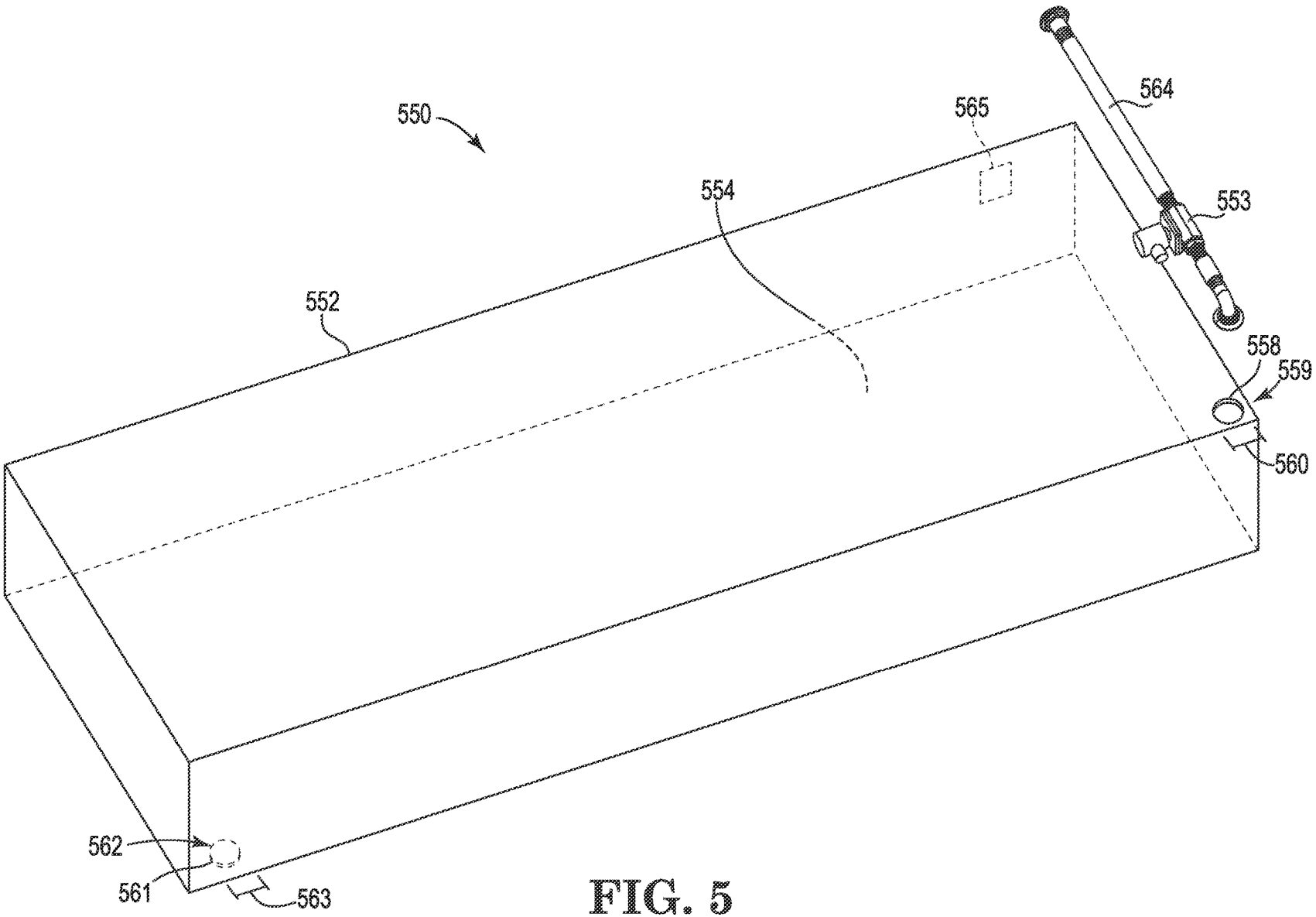
FIG. 5 is an exploded perspective view of a ballast apparatus in accordance with one or more embodiments of the present disclosure.

As shown in more detail in FIG. 5, The bottom opening of a ballast tank in accordance with the present disclosure may be intentionally located towards the stern end 406-2 of the ballast tank. For example, a bottom opening of a ballast tank may be located as far back in the ballast tank as practicable (e.g., within one-half inch of the stern end 406-2 of the ballast tank). By such placement, embodiments herein can increase the rate and/or completeness of ballast drainage via the bottom opening when the watercraft 400 is operating at speed and the bow 406-1 is elevated with respect to the body of water. Similarly, the bottom opening of a ballast tank may be located towards the centerline of the watercraft 400 to increase the rate and/or completeness of ballast drainage via the bottom opening. For example, a bottom opening of a ballast tank may be located as close to the centerline of the watercraft 400 as practicable (e.g., within one-half inch of a medial side of the ballast tank). This placement may be intentionally selected in watercraft having a v-shaped hull, for instance, as the centerline 424 may embody the lowest portion of the watercraft 400. It is noted that the third bottom 462-3 opening shown in FIG. 4 is located adjacent to the centerline rather than directly on the centerline. In some embodiments, it may be desirable to maintain the structure of the keel 424 along the entire length of the watercraft 400 and thus the bottom opening 462-3 may be located close to the centerline without interfering with the keel 424 (e.g., within one-half inch of the keel 424).

According to various embodiments, the bottom openings 462 are fixed permanently open. Stated differently, in some embodiments the bottom openings 462 are not designed to be or intended to be closable, sealable, and/or stoppable. Water can be selectively allowed to enter the ballast tank(s), be retained in the ballast tank(s), and/or drained from the ballast tanks via the control of one or more of the valves (553 in FIG. 5) associated with the top opening(s) (559 in FIG. 5) connected to a plurality of hull side openings, 457-1, 457-2 and 457-3 (collectively referred to as "hull side openings 457") through a conduit via the valve (553 in FIG. 5) to the side of the hull 404. These openings 457 are referred to herein as "hull side openings." For instance, the watercraft 400 includes a first hull side opening 457-1, a second hull side opening 457-2, and a third hull side opening 457-3 (cumulatively referred to as "hull side openings 457"). The hull side openings 457 can be located along a side of the watercraft 400 and positioned above a waterline (115 in FIG. 1B) of the watercraft 400 (e.g., above a surface of a body of water (101 in FIG. 1B) where the watercraft 400 is operating). The hull side openings 457 and their functionalities may be described in further detail below in connection with FIGS. 5 and 6.

FIG. 5 is an exploded perspective view of a ballast apparatus 550 in accordance with a number of embodiments of the present disclosure. For example, the ballast apparatus 550 shown in FIG. 5 can be analogous to the first ballast apparatus 250-1 and/or the first ballast apparatus 350-1, illustrated in FIGS. 2 and 3, respectively. As shown in FIG. 5, the ballast apparatus 550 includes a ballast tank 552. The ballast tank 552 can be substantially rectangular in shape and comprised of a plurality of panels or sheets, however, embodiments may not be limited to a particular geometry. In some embodiments, the ballast tank 552 is made from aluminum (e.g., 5053 aluminum alloy) panels. Embodiments, however, are not limited to a particular material. In aluminum and/or metal single hull (404 in FIG. 4) embodiments, the panels can be welded at the joints to form the ballast tank 552. The bottom surface of the ballast tank 552 can be the hull (404 in FIG. 4) of the watercraft (400 in FIG. 4). Stated differently, the ballast tank 552 can be fabricated by welding the sides directly to the interior surface of the hull. In some embodiments, a thickness of the panels comprising the ballast tank 552 can be in a range of ⅛ inch to 1.0 inch in thickness, or greater. In one example embodiment, the ballast tank 452 has a thickness of approximately 0.1875 inches (e.g., $9/64^{th}$s of one inch). Embodiments include other thicknesses according to a particular design rule.

The ballast tank 552 can include a first surface 558 defining a top opening 559 on the ballast tank 552. The top opening 559 can extend via a conduit 564 from an interior 554 of the ballast tank 552 through a valve 553 to a hull side opening (457 in FIG. 4) located on an exterior side portion of the hull (404 in FIG. 4). The top opening 559 can define a path for the passage of air from the exterior of the hull to the interior 554 of the ballast tank 552 and vice versa. The top opening 559 can be circular, though embodiments of the present disclosure are not so limited. For example, the top opening 559 can be a circular opening having a diameter 560. In some embodiments, the diameter 560 is 1.0 inches. In some embodiments, the diameter 560 is between 0.5 inches and 3.0 inches. The top opening can be formed by removing a portion of the top surface of the ballast tank 552, for instance (e.g., via drill, laser, plasma cutter, water jet, punch, hole saw, etc.).

The top opening 559 connects the ballast tank 552 to the conduit 564. The conduit 564 is an elongate member extending between the ballast tank 562 and the exterior of the hull that allows the passage of air therein. The conduit can be a pipe, hose, duct, tube, or other type of material for a conduit 564. In some embodiments, the conduit 564 can be flexible. In other embodiments, the conduit 564 may be rigid. The conduit 564 can be formed from any suitable material including, for instance, aluminum, steel (e.g., stainless steel), polymer (e.g., polyvinyl chloride (PVC), polyethylene, etc.), and/or rubber. The conduit 564 can be coupled to the ballast tank 552 via any suitable coupling including, for instance, welding, adhesive(s), and/or mechanical fastening.

The passage of air through the top opening 559 can be regulated closed (or opened) via a valve 553 connected in the path formed by the conduit 564 from the exterior of the hull (404 in FIG. 4) to the top opening 559 of the ballast tank 552. The valve 553 is a device that selectively allows or prevents the passage of air through the top opening 559. In some embodiments, the valve 553 may allow the passage of air in one direction but not in the opposing direction. It is noted that while the example of one valve per ballast tank 552 is described herein, embodiments of the present disclosure are not so limited. In some embodiments, the valve 553 can be formed of stainless steel. In some embodiments, the valve 553 can be a manual valve and/or a solenoid valve. In some embodiments, the valve 553 can be battery-driven (e.g., via a 12-volt battery system or 24-volt battery system).

The ballast tank 552 can include a second surface 561 defining a bottom opening 562. The bottom opening 562 can extend from the interior 554 of the ballast tank 552 through a bottom portion of the hull to an exterior of the bottom portion of the hull. The bottom opening 562 can define a path for the passage of water from a body of water (e.g., 101 in FIG. 1B) exterior to the hull (404 in FIG. 4) to the interior 554 of the ballast tank 552 and vice versa. The bottom opening 562 can be circular, though embodiments of the present disclosure are not so limited. For example, the bottom opening 562 can be a circular opening having a diameter 563. In some embodiments, the diameter 563 is 3.0 inches. In some embodiments, the diameter 563 is between 2.0 inches and 5.0 inches. The bottom opening 562 can be formed by removing a portion of the hull of the watercraft, for instance (e.g., via drill, laser, plasma cutter, water jet, punch, hole saw, etc.). As previously discussed, the bottom surface of the ballast tank 552 can be the hull of the watercraft. Thus, a thickness of the second surface 561 defining the bottom opening 562 can correspond directly to a thickness of the hull. In some embodiments, that thickness can be 3/16 inch. Embodiments may include other thicknesses according to a particular design rule. Accordingly, the length of the second surface 561 defining the bottom opening 562 may be continuous with a bottom length of the hull (404 in FIG. 4) of the recreational watercraft (400 in FIG. 4) and may exceed (e.g., greatly exceed) a length of the first surface 558 defining the top opening 559.

The ballast tank 552 can include a sensing device 565. In some embodiments, the sensing device 565 can determine a ballast water level and/or ballast water volume within the ballast tank 552. In some embodiments, the sensing device 565 can be configured to determine when the ballast tank 552 is full of ballast water. The sensing device 565 can communicate with the control console in either a wired and/or wireless manner using radio or other frequencies for communication. Accordingly, an operator of the watercraft can be notified of the status of the ballast tank 552(*s*) fluid level in the ballast apparatuses 550 of recreational watercraft (400 in FIG. 4). The sensing device 565 can be any suitable type of sensing device 565. For example, the sensing device 565 can include a float and/or a liquid level sensor and/or calculate or facilitate calculation of a volume therefrom based on a known dimension of the ballast tank 552. The sensing device 565 can produce a digital and/or analog output to the control console. Though one sensing device 565 is shown in FIG. 5, embodiments herein are not limited to a particular number of or location to the sensing devices 565 associated with the ballast tank 552.

Figure 6A:
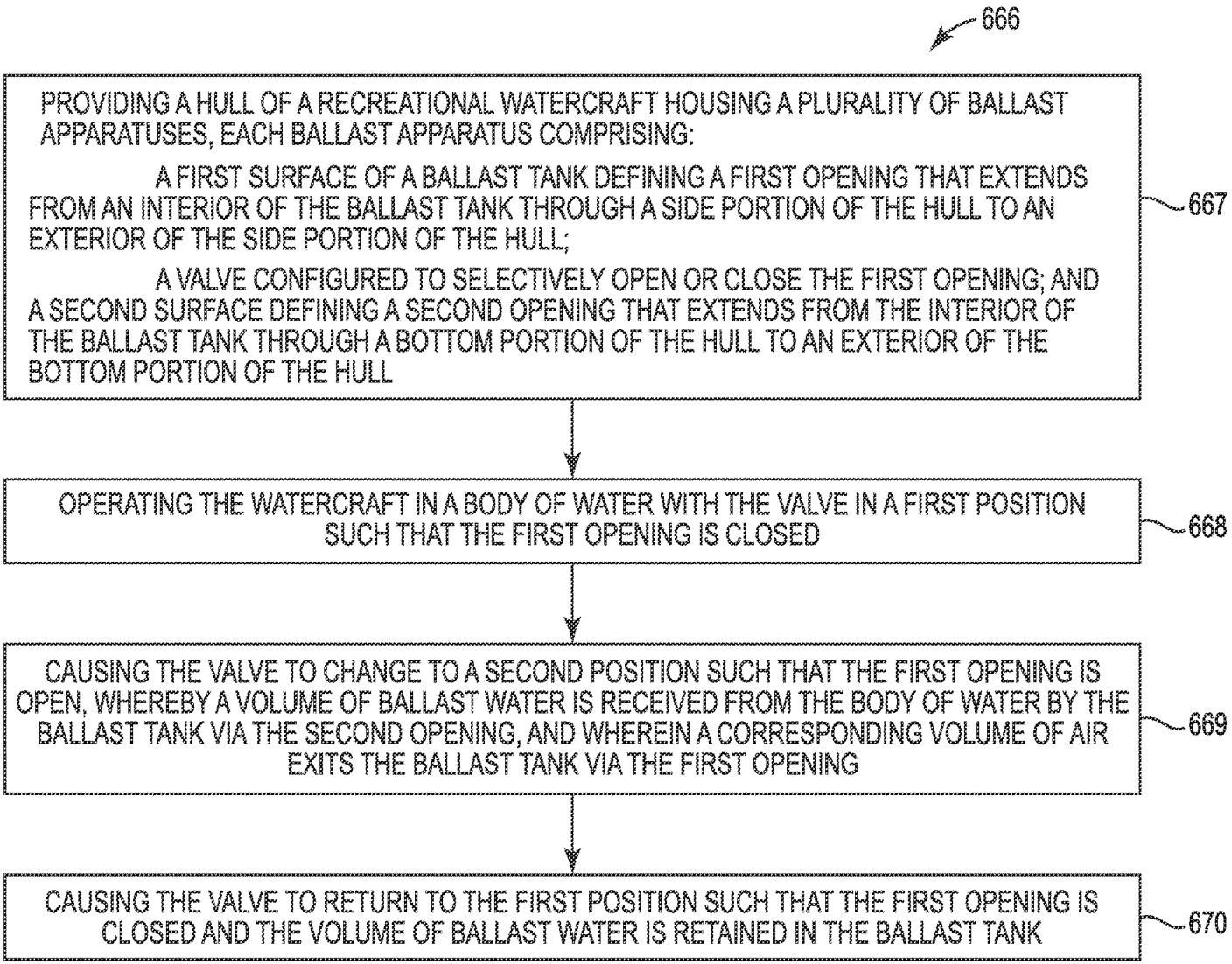
FIG. 6A is a flow diagram representing an example method for operating a recreational watercraft in accordance with one or more embodiments of the present disclosure.
Figure 6B:
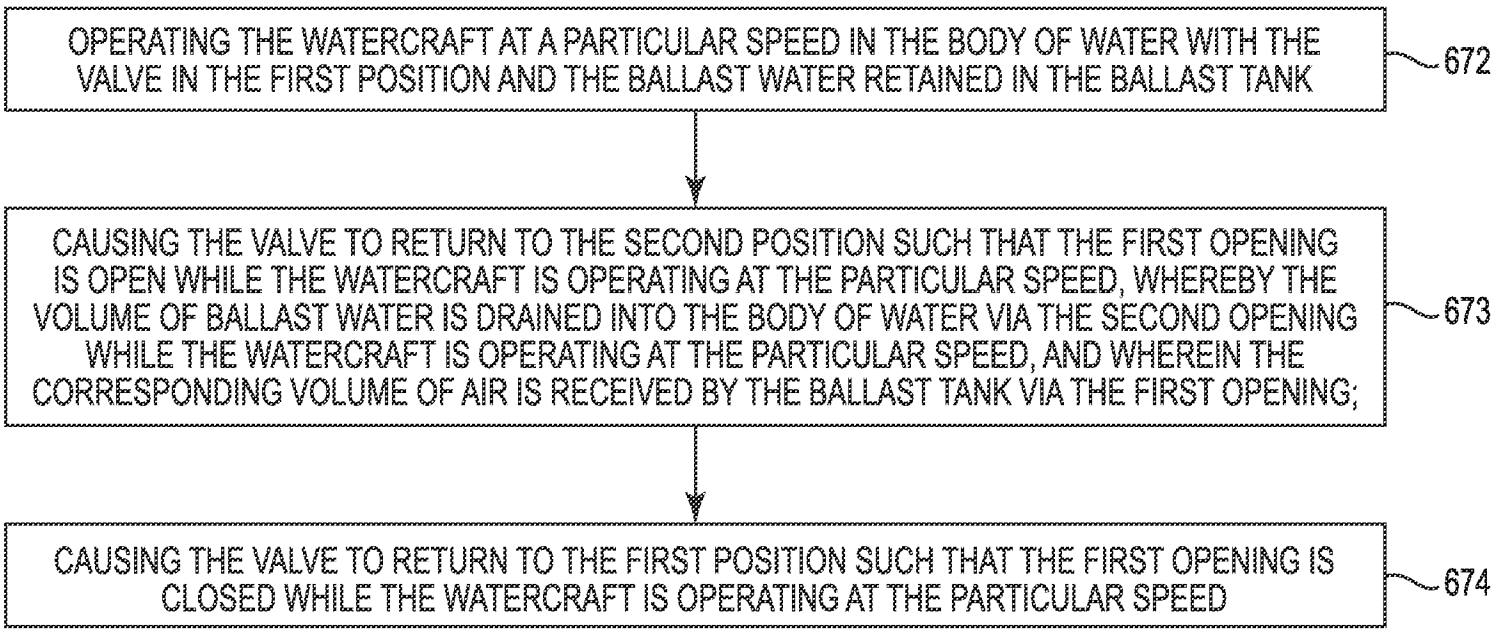
FIG. 6B is a flow diagram representing another example method for operating a recreational watercraft in accordance with one or more embodiments of the present disclosure.

FIG. 6A is a flow diagram representing an example method 666 for operating a recreational watercraft in accordance with a number of embodiments of the present disclosure. FIG. 6B is a flow diagram representing another example method 671 for operating a recreational watercraft in accordance with a number of embodiments of the present disclosure. FIGS. 6A and 6B may be cumulatively referred to herein as "FIG. 6"). The method 666 illustrated in FIG. 6A can represent a process for filling the ballast tank(s) of the watercraft, for instance. The method 671 illustrated in FIG. 6B can represent a process for draining the ballast tank(s) of the watercraft, for instance.

In FIG. 6A, at 667, the method 666 includes providing a hull of a recreational watercraft housing a plurality of ballast apparatuses (550 in FIG. 5). Each of the plurality of ballast apparatuses can include a first surface (558 in FIG. 5) of a ballast tank (552 in FIG. 5) defining a first opening (559 in FIG. 5) that extends via a conduit (564 in FIG. 5) from an interior (554 in FIG. 5) of the ballast tank through a valve (553 in FIG. 5) to a hull side opening (457 in FIG. 4) on an exterior of a side portion of the hull (404 in FIG. 4). Each of the plurality of ballast apparatuses can include a valve (553 in FIG. 5) configured to selectively open or close passage of air and/or liquid (e.g., water) via the conduit (564 in FIG. 5) through the first opening (559 in FIG. 5). Each of the plurality of ballast apparatuses (550 in FIG. 5) can include a second surface (561 in FIG. 5) defining a second opening (562 in FIG. 5) that extends from the interior (554 in FIG. 5) of the ballast tank through a bottom portion of the hull (404 in FIG. 4) to an exterior of the bottom portion of the hull (400 in FIG. 4).

At 668, the method 666 includes operating the watercraft in a body of water with the valve (553 in FIG. 5) in a first position such that the valve is closed and the passage of air and/or liquid (e.g., water) via the conduit (564 in FIG. 5) through the first opening (559 in FIG. 5) is prevented. With the valve (553 in FIG. 5) in the closed position, water is prevented from entering the ballast tank via the bottom opening (562 in FIG. 5) because the air in the ballast tank is prevented from venting out the top opening (559 in FIG. 5) through the conduit (564 in FIG. 5) and the closed valve (553 in FIG. 5) to the hull side opening (457 in FIG. 4). In effect, the valve (553 in FIG. 5) in the first, closed position creates a vacuum seal and/or barrier to air flow.

At 669, the method 666 includes causing the valve to change to a second position such that the valve (553 in FIG. 5) is open, releasing the vacuum seal to air flow, and air and/or liquid may pass through the first opening (559 in FIG. 5), whereby a volume of ballast water is received from the body of water by the ballast tank via the second opening (562 in FIG. 5), and wherein a corresponding volume of air exits the ballast tank via the first opening (559 in FIG. 5) through the conduit (564 in FIG. 5) and through the valve to the hull side opening (457 in FIG. 4). Once the pressurized air in the ballast tank is released through the top opening (559 in FIG. 5) via the valve (553 in FIG. 5) and through the conduit (564 in FIG. 5) to the hull side opening (457 in FIG. 4), water from the body of water (101 in FIG. 1B) can rush in to take its place in the ballast tank.

At 670, the method 666 includes causing the valve to return to the first position such that the passage of air and/or liquid (e.g., water) via the conduit (564 in FIG. 5) through the first opening (559 in FIG. 5) is closed, e.g., blocked, and the volume of ballast water is retained in the ballast tank (552 in FIG. 5) by vacuum seal. In a manner similar to the retention of liquid in a drinking straw by the placement of a finger over the top opening, the closure of the top opening by the valve creates a vacuum and prevents the entry of air into the ballast tank from above which would otherwise permit the flow of the ballast water from out of the bottom opening (562 in FIG. 5) into the body of water (101 in FIG. 1B) even under Venturi forces while the recreational watercraft (400 in FIG. 4) is travelling across the body of water (101 in FIG. 1B).

In some embodiments, the valve (553 in FIG. 5) can return to the closed position responsive to a signal received from a sensing device, as described herein. In such embodiments, the closure of the valve may be performed automatically (e.g., without operator input). In some embodiments, the valve can return to the closed position responsive to an input made via an interface on the control console, previously discussed in connection with FIG. 1A. Such an input can represent a manual closure of the valve. In other embodiments, the valve (553 in FIG. 5) may be physically closed by mechanical action and intervention by an operator physically accessing the valve as a safety, failover fall back action. In either case, the valve may be closed when the ballast tank is partially full or completely full and the volume of ballast water can be retained in the ballast tank (552 in FIG. 5) so long as the valve (553 in FIG. 5) remains closed. In this manner an operator can control an amount of water taken onboard into the ballast tanks (552 in FIG. 5) of the recreational watercraft (400 in FIG. 4) to regulate an amount of water displacement by the recreational watercraft (400 in FIG. 4). The recreational watercraft (400 in FIG. 4) can be operated (e.g., in the pursuit of wake sports and/or towed water sports) with the volume of ballast water retained in the ballast tank regulating a wake size and shape produced by the recreational watercraft (400 in FIG. 4).

FIG. 6B is a flow diagram representing another example method 671 for operating a recreational watercraft in accordance with a number of embodiments of the present disclosure. As previously discussed, the method 671 can represent a process for draining the ballast tank(s) of the recreational watercraft (400 in FIG. 4), for instance. At 672, the method 671 can include operating the watercraft at a particular speed in the body of water with the valve (553 in FIG. 5) in the first position (e.g., closed) and the ballast water retained in the ballast tank (553 in FIG. 5). At 673, the method 671 can include causing the valve to return to the second position such that the valve (553 in FIG. 5) is open and allowing the passage of air and/or liquid (e.g., water) via the conduit (564 in FIG. 5) through first opening (559 in FIG. 5) while the watercraft is operating at the particular speed, whereby the volume of ballast water is drained into the body of water (101 in FIG. 1B) via the second opening (562 in FIG. 5), un-regulated by any valve and permanently fixed open, while the watercraft is operating at the particular speed, and wherein the corresponding volume of air is received into the ballast tank (552 in FIG. 5) via the first opening (559 in FIG. 5). Opening the valve can allow air to push down into the ballast tank (552 in FIG. 5) from above via the hull side opening (457 in FIG. 4), through the conduit (564 in FIG. 5), the open valve (553 in FIG. 5), and the top opening (559 in FIG. 5) and, as the watercraft is operated at speed, the Venturi effect of the water passing by the bottom opening (562 in FIG. 5) tends to reduce the pressure within the ballast tank. As a result, the ballast water in the ballast tank (552 in FIG. 5) drains out the bottom opening (562 in FIG. 5) back into the body of water (101 in FIG. 1B). In some embodiments, the particular draining speed for operating the recreational watercraft (400 in FIG. 4) can be between 8.0 and 15 miles per hour. In some embodiments, the particular draining speed for operating the recreational watercraft (400 in FIG. 4) can be any operating speed exceeding 8.0 miles per hour. Embodiments can include different speeds depending on a size and weight of the recreational watercraft (400 in FIG. 4), ballast tanks (552 in FIG. 5), openings (559 and 562 in FIG. 5), valve (553 in FIG. 5), and/or conduit (564 in FIG. 5).

At 674, the method 671 can include causing the valve to return to the first position such that the valve (553 in FIG. 5) is closed while the recreational watercraft (400 in FIG. 4) is operating at the particular speed. Closure of the valve again prevents the passage of water from the body of water (101 in FIG. 1B) into the ballast tank (552 in FIG. 5) via the bottom opening (562 in FIG. 5) which is permanently fixed open and un-regulated by a direct valve connection, even after the watercraft slows below the particular speed and/or is at rest on the body of water (101 in FIG. 1B) because of the air trapped in the ballast tank (552 in FIG. 5) with no escape passage through the conduit (564 in FIG. 5) to the hull side opening (457 in FIG. 4). In this manner, embodiments of the present disclosure provide a pump-less ballast apparatus (550 in FIG. 5) (e.g., ballast systems without requiring the use of mechanical and/or electrical pumps and/or pumping devices) for the disclosed recreational watercraft (400 in FIG. 4).

It is noted that removal of the watercraft from the body of water may cause the ballast tank to drain, even if the valve is in the closed position. in some embodiments, when both the top and bottom opening are above the surface of the water, the downward force of gravity on the ballast water can be sufficient to cause the ballast water to drain out of the ballast tank via the bottom opening. As a result, even if the operator fails to drain the ballast tank before trailering the watercraft, the ballast water will drain by itself. This drainage, even in the face of operator error or negligence, is desirable in more than one respect. For example, the operator can be saved from the costs and danger associated with towing an over-weighted watercraft, the spread of aquatic invasive species through ballast water can be avoided, and governmental agencies can be relieved of the need to painstakingly inspect the ballast tank(s) of such embodiments of the present disclosure.

Other watercraft using ballast systems may employ mechanical and/or manual pumps with their ballast systems. These are less advantageous than the present disclosure because such systems require additional electrical systems and consume valuable power supply resources such as batteries. Manual systems require exertion of measurable effort by an operator of those systems. Hence, the pump-less ballast apparatuses (550 in FIG. 5) embodiments (e.g., without using electrical or mechanical pumping systems) of the present disclosure provide notable benefit.

Figure 7A:
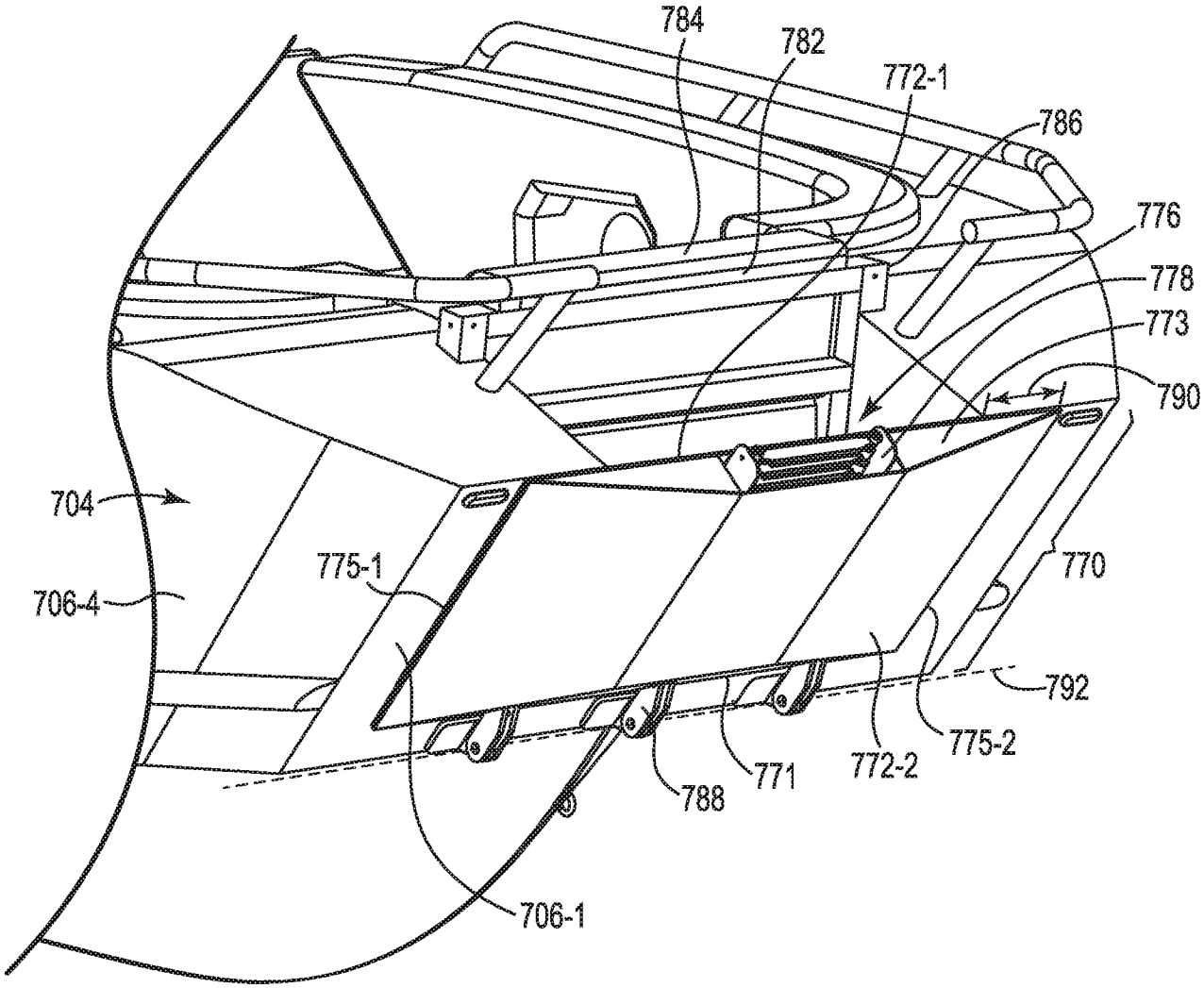
FIG. 7A illustrates a perspective view of a portion of a recreational watercraft including a panel drop down boarding point in a closed position in accordance with a number of embodiments of the present disclosure.

FIG. 7A illustrates a perspective view of a portion of a recreational watercraft including a panel drop down boarding point in a closed position in accordance with a number of embodiments of the present disclosure. The panel drop down boarding point can be hingedly attached horizontally to the hull of the recreational watercraft for ingress and egress to the recreational watercraft, as further described below. The panel drop down boarding point can have an opening in an end surface of the panel drop down boarding point for access to an aperture. The aperture can house a retractable ladder and allow for the retractable ladder to extend out through the opening. As used herein, the term "retractable ladder" includes a device with at least two sections arranged so that they fit together and/or extend on a sliding mechanism.

As shown in FIG. 7A, the recreational watercraft can include a hull 704, an open platform passenger deck integral to an upper surface to the hull 704, and a plurality of sides. The plurality of sides can include a stern side, a bow side 706-1, a port side, and a starboard side 706-4, (not shown in FIG. 7A) analogous to the plurality of sides described in connection to FIG. 1. In some embodiments, the recreational watercraft can include a panel drop down boarding point 770 in the bow side 706-1, as shown in FIG. 7A.

As described herein, the panel drop down boarding point 770 can be hingedly attached horizontally to the hull of the recreational watercraft for ingress and egress to the recreational watercraft. The panel drop down boarding point can be hingedly attached horizontally to the hull via one or more hinges. As used herein, the term "hinge" refers to a movable joint device on which the panel drop down boarding point can extend and/or unextend. In some embodiments, the panel drop down boarding point can include a telescoping piston, as further described herein.

Figure 7B:
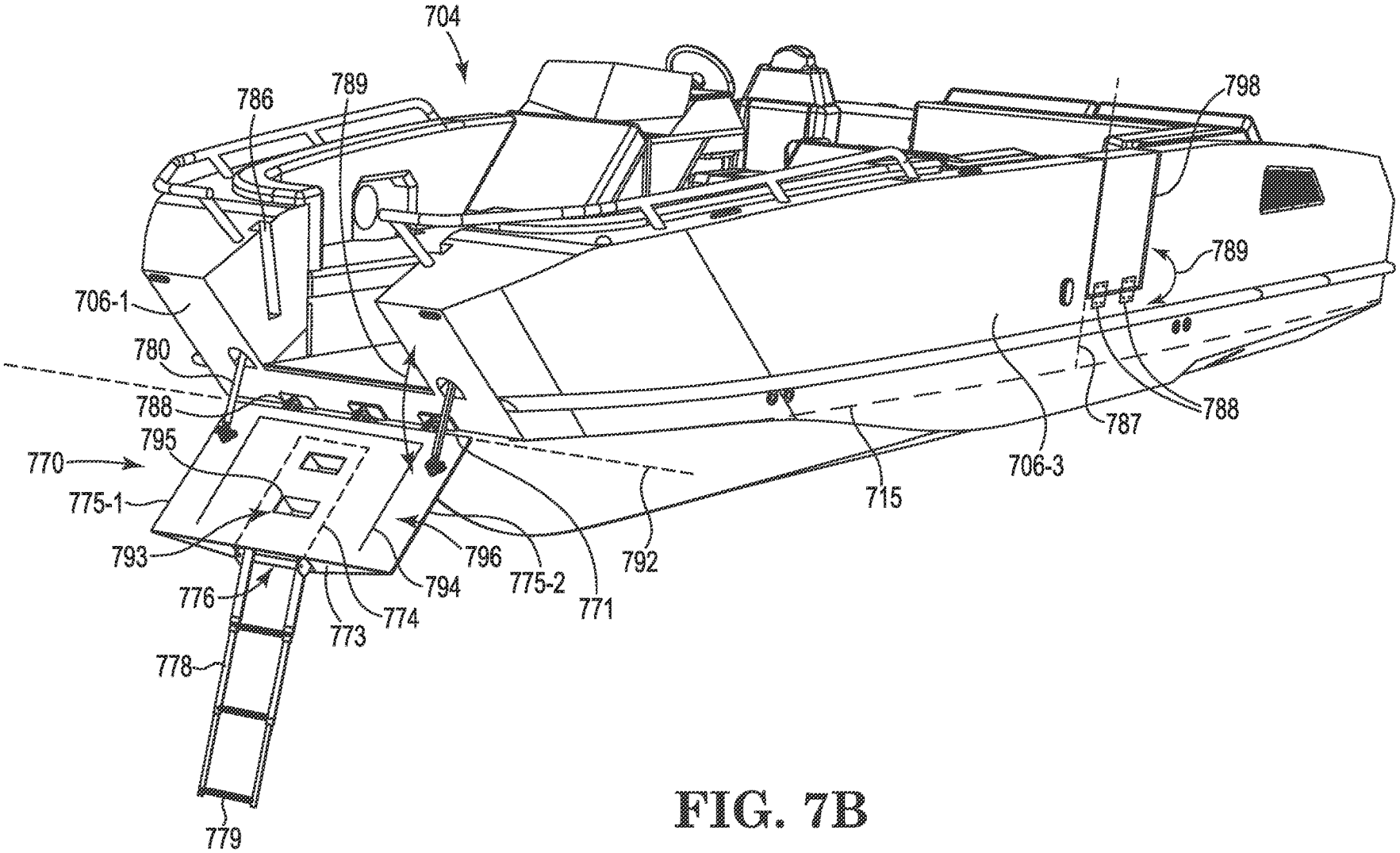
FIG. 7B illustrates a perspective view of a portion of a recreational watercraft including a panel drop down boarding point in an opened position with a retractable ladder in an extended position in accordance with a number of embodiments of the present disclosure.
Figure 7D:
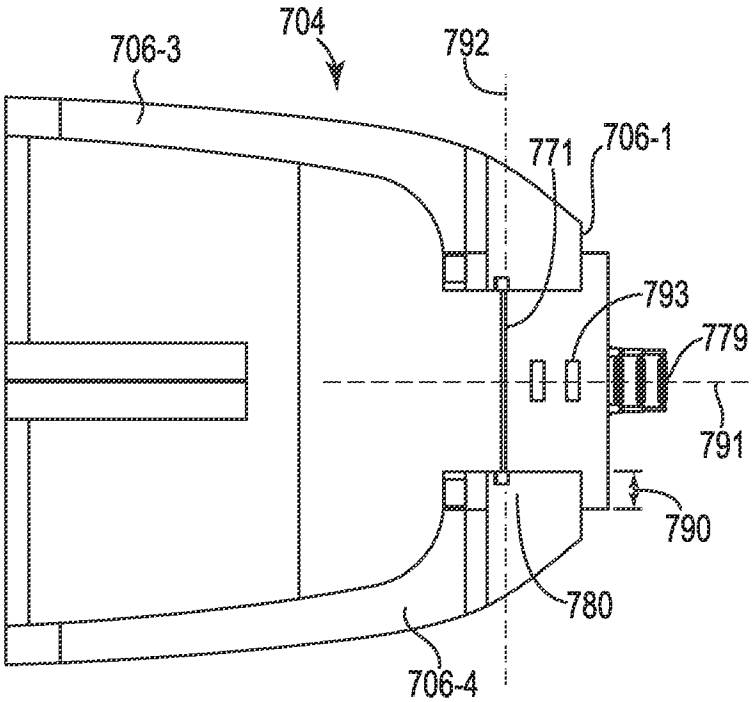
FIG. 7D illustrates a top cross-sectional view of a portion of a recreational watercraft including a panel drop down boarding point in an opened position with a retractable ladder in an extended position in accordance with a number of embodiments of the present disclosure.
Figure 7C:
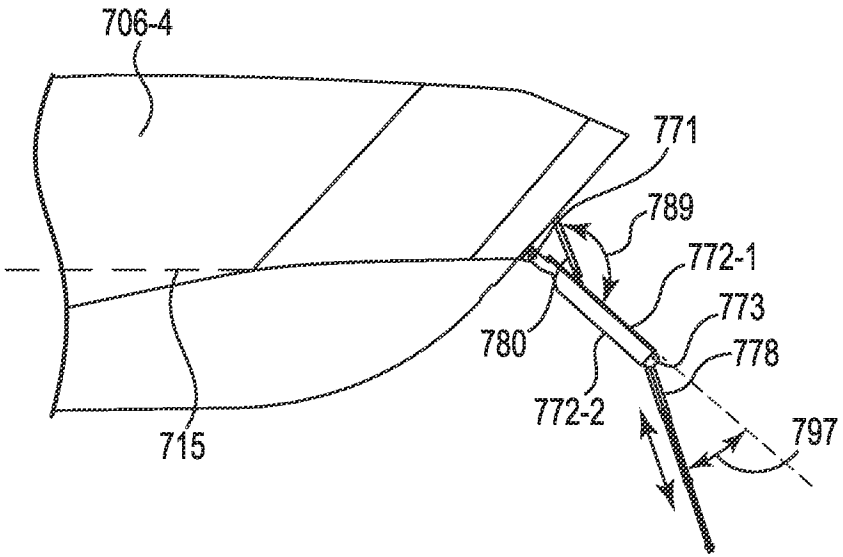
FIG. 7C illustrates a side view of a portion of a recreational watercraft including a panel drop down boarding point in an opened position with a retractable ladder in an extended position in accordance with a number of embodiments of the present disclosure.

As shown in FIG. 7A, the recreational watercraft can include a panel drop down boarding point 770. In the example, the panel drop down boarding point 770 includes a first surface 772-1, a second surface 772-2, an aperture 774 (shown in FIG. 7B), an opening 776, and a retractable ladder 778. In FIG. 7A, the panel drop down boarding point is in a closed position. In some embodiments, the panel drop down boarding point is in an open position, as shown in FIGS. 7B-7D.

As shown in FIG. 7A, the panel drop down boarding point 770 can include a first surface 772-1 defining an inner surface. As used herein, the first surface is the interior surface facing the recreational watercraft when the panel drop down boarding point 770 is in a closed position. As shown in FIG. 7A the panel drop down boarding point 770 can include a second surface 772-2, opposite to the first surface 772-1, defining an outer surface. As used herein, the second surface is the exterior surface facing away from the recreational watercraft when the panel drop down boarding point 770 is in a closed position. In some embodiments, the panel drop down boarding point can be hingedly attached horizontally to the hull via hinges 788. Hinges 788 can be movable joint devices on which the panel drop down boarding point 770 can extend and/or unextend. For example, the hinges can rotate about a lateral axis 792 which is located at or near to bottom 771 of the panel drop down boarding point.

The panel drop down boarding point can be trapezoidal in shape. The trapezoidal shape of the panel drop down boarding point can facilitate docking to a specific surface and/or at a preferred angle. The panel drop down boarding point can be used for ingress and egress of persons to the recreational watercraft.

The panel drop down boarding point can be adjusted according to a user's preference. For example, a user can adjust the panel drop down boarding point to be at a 90-degree angle from a vertical reference line to facilitate a device with wheels (e.g., wheelchair, etc.) to ingress and/or egress the recreational boarding point. In some embodiments, the user can adjust the panel drop down boarding point to be parallel to a dock to make ingress and/or egress easier from the dock. Yet, in some embodiments, the user can adjust the panel drop down boarding point based on the depth of the water to board back onto the recreational watercraft after a swim. The range of the panel drop down boarding point from a fully closed to fully deployed position can be 180-degrees from the vertical reference line.

Control of the panel drop down boarding point can be provided via the control console. The control elements can be buttons, levers, switches, and/or display elements (e.g., icons) of a displayed interface. In some embodiments, a manual switching mechanism can be used to control the opening and closing of the panel drop down boarding point.

In some embodiments, the manual switching mechanism can be located in the bow side of the hull of the recreational watercraft.

In some embodiments, the first surface 772-1 can include a plurality of boarding grip points. The boarding grip points, as further described herein, can be fabricated in the first surface of the panel drop down boarding point 770. The boarding grip points can be beneficial in assisting a person getting into or out of the water and act as a transition between the ladder and the interior of the watercraft.

In some embodiments, the first surface 772-1 can include a first portion and a second portion, opposite to the first portion. The first surface 772-1 can include a first portion and a second portion. Similarly, second surface 772-2 can include a first portion and a second portion, opposite to the first portion.

In some embodiments, the first portion of the first surface 772-1 of the panel drop down boarding point 770 and a first portion of the second surface 772-2 of the panel drop down boarding point 770 are joined together at a first edge 775-1. Similarly, a second portion of the first surface 772-1, of the panel drop down boarding point 770 and a second portion of the second surface 772-2 of the panel drop down boarding point are joined together at a second edge 775-2. The first portions and the second portions of the first surface 772-1 and the second surface 772-2 can be joined by any suitable joinder process. In some embodiments, for example, the first surface 772-1 and the second surface 772-2 can be joined via techniques such as welding, soldering, brazing, riveting, using adhesives, etc.

As discussed above, the panel drop down boarding point 770 can include an aperture 774 formed between the first surface 772-1 and the second surface 772-2. The aperture 774 can have an opening 776 in an end surface 773 of the panel drop down boarding point 770. In some embodiments, the aperture 774 can be sized and shaped to house a retractable ladder 778 and the ladder can extend out through the opening 776.

The retractable ladder 778 of the panel drop down boarding point 770 can have at least two sections arranged so that they fit together or extend on a sliding mechanism. In some embodiments, the retractable ladder 778 can include a telescoping ladder. The retractable ladder 778 can include a telescoping ladder that telescopes from a first length to a second length when extended out of the aperture 774 in the panel drop down boarding point 770. For instance, the retractable ladder 778 can telescope from a first length of two feet to a second length of six feet when extended out of the aperture.

The retractable ladder 778 can include multiple rungs 779. In some embodiments, the retractable ladder 778 can include recesses that provide boarding grip points aligned with the multiple rungs when the retractable ladder extends out of the aperture in the panel drop down boarding point 770. In some embodiments, the retractable ladder 778 can be affixed into the aperture 774 permanently. In some embodiments, the retractable ladder 778 can be removably affixed from the aperture 774 to completely remove the ladder from the aperture.

As described in FIG. 7A, the recreational watercraft can include mounting frame 782, mounting bracket 786, removable seats 784, a panel drop down boarding point 770, and a plurality of hinges 788. In some embodiments, the recreational watercraft can include the panel drop down boarding point 770 on the bow side 706-1, though it is noted that the present disclosure is not so limited. For perspective, the mounting bracket 786 for the removable seat is also shown in the opening in the bow side 706-1 in FIG. 7B.

FIG. 7B illustrates a perspective view of a portion of a recreational watercraft including a panel drop down boarding point in an opened position with a retractable ladder in an extended position in accordance with a number of embodiments of the present disclosure. In FIG. 7B, the recreational watercraft includes a panel drop down boarding point 770 on the bow side 706-1 of hull 704. FIG. 7B illustrates the retractable ladder 778 having a plurality of rungs 779 and being in an extended position illustrating how a rider could use the combination of the boarding grip points 793 of the panel drop down boarding point 770 and the extended ladder 778 to get into and out of the water.

As discussed above, the retractable ladder 778 can be stored in aperture 774 and extend out through the end surface 773 via the opening 776, as described herein, and extend to, at, and/or below the waterline 715. The panel drop down boarding point 770 can include a telescoping piston 780. In some embodiments, the telescoping piston 780 can be located on each side of the panel drop down boarding point 770, as shown in FIG. 7B.

The telescoping piston 780 can be attached between the first surface 772-1 and the hull 704 to adjust the panel drop down boarding point 770 as the telescoping piston 780 moves between an extended and/or an unextended condition. The piston 780 can be mounted to the hull 704 in any suitable manner. As the piston 780 articulates between an extended condition and an unextended condition, the panel drop down boarding point 770 rotates along a rotational path 789. The range of angles (from a vertical reference point such as reference line 787 or a closed position of the panel drop down boarding point 770 can, for example, have a range of between 0 degrees and 180 degrees.

The telescoping piston 780 can be electrically driven. This can be beneficial, for example, as electrically driven pistons (as opposed to hydraulically driven pistons) can be more precisely lengthened which may be helpful in aligning the panel drop down boarding point during when preparing to board or disembark. This precision is possible because electrically driven pistons utilize a screw drive system wherein the electric motor turns a screw mechanism inside the piston to extend or retract the length of the piston and thereby can be stopped at any point along its range from unextended to extended.

As discussed above, the panel drop down boarding point 770 can rotate via hinges 788 about a lateral axis 792. The lateral axis 792 can be an defined by a line parallel to the direction of elongation of a side of the recreational watercraft. In some embodiments, when the panel drop down boarding point 770 is to be opened, the hinges 788 can rotate from a bottom 771 of the panel drop down boarding point around the lateral axis 792 to extend the panel drop down boarding point 770 toward waterline 715, as shown in FIG. 7B. The rotational motion of the panel drop down boarding point 770 between opened and closed positions is shown at 789.

Further, in some embodiments, when the panel drop down boarding point 770 is to be closed, the hinges 788 can rotate around the lateral axis 792 to retract the panel drop down boarding point 770 from the waterline 715 toward the hull 704. As described herein, when the panel drop down boarding point 770 is retracted and in a closed position, the panel drop down boarding point 770 can overlap with a portion of the hull 704 on either side (at 790 of FIG. 7A). The benefits of this overlap will be discussed in more detail below.

In some embodiments, the first surface 772-1 of the panel drop down boarding point 770 can include a plurality of boarding grip points 793. The boarding grip points 793 can be provided in the first surface 772-1 of the panel drop down boarding point 770.

The grip points 793 can include hand/foot contacting portion 795 for the placement of a hand or foot to assist users in ingress and egress to the recreational watercraft 770 from the water. In some embodiments, the hand/foot contacting portion can have a non-slip surface. The non-slip surface can be created, for example, by adding texture to the surface and/or by applying a non-slip material to the surface of the hand/foot contacting portion.

The recreational watercraft, as shown in FIG. 7B, can include a second panel drop down boarding point 798 to a port side 706-3. The second panel drop down boarding point 798 can comprise the same component and function is a similar manner as the panel drop down boarding point 770. As discussed herein, embodiments can include panel drop down boarding points on multiple sides (e.g., panel drop down boarding points on bow, side, port side, starboard side, and/or stern side). In such embodiments, the second panel drop down boarding point 798 can open at a rotational angle, for example, as show at 789. Additionally or alternatively, a panel drop down boarding point could be positioned at an opening on the starboard side and be configured in a similar manner.

As described herein, the first surface of the panel drop down boarding point 770 is sized such that a portion of the first surface overlaps a portion of a bow surface of the hull of the recreational watercraft 770. One benefit of having this overlap can be that the end of the piston can be positioned on the overlapped portions of the side (e.g., bow side 706-1) and the panel drop down boarding point 770. Another benefit is that a sealing mechanism can be positioned on the side or the panel drop down boarding point to reduce the passage of water between the panel drop down boarding point and the side. This can be helpful in keeping riders, seats, and belongings kept on the recreational watercraft dry.

For example, in some embodiments, the portion of the first surface of the panel drop down boarding point that overlaps the portion of the bow surface of the hull can include a sealant material. The sealant material 796 can be on at least part of the portion of the first surface of the panel drop down boarding point to reduce passage of water when the panel drop down boarding point is in the closed position. Any suitable sealant material (e.g., a rubberized coating, silicon coating, etc., applied to one or both surfaces) that can reduce the passage of water between the panel drop down boarding point and the side can be utilized. In some embodiments, the portion of the first surface that overlaps the portion of the bow surface of the hull includes a resilient gasket 794 attached thereto. The resilient gasket 794 can act as a seal that fills the space between the portion of the first surface and portion of the side surface that overlap. As used herein, a resilient material can be compressed, will deform, and will return to its original shape when uncompressed. Examples, of resilient materials include: rubberized material, silicone material, etc.

FIG. 7C illustrates a side view of a portion of a recreational watercraft including a panel drop down boarding point in an opened position with a retractable ladder in an extended position in accordance with a number of embodiments of the present disclosure. The recreational watercraft is in a body of water and 715 can be the waterline above which the starboard side 706-4 of the recreational watercraft is positioned. As shown in FIG. 7C, when the telescoping piston 780 is in an extended position, the panel drop down boarding point 770 rotates about a lateral axis on a rotational path 789. Though angle shown in FIG. 7C of the panel drop down boarding point 770 is at 90 degrees from the closed position, embodiments herein are not limited to a particular angle.

As shown in FIG. 7C, the first surface 772-1, interior to the recreational watercraft when the panel drop down boarding point 770 is in a closed position, can be oriented to face a direction opposite to the hull of the recreational watercraft when open to a wide angle. The second surface 772-2, exterior to the recreational watercraft when the panel drop down boarding point 770 is in a closed position, faces towards the away from the hull 704.

As shown in the example 7C, the retractable ladder 778 is in an extended position from the end surface 773 of the panel drop down boarding point 770. As described herein, the retractable ladder 778 can be housed in the aperture 774. Aperture 774 can have an opening 776 in an end surface 773 of the panel drop down boarding point 770. In some embodiments, the aperture 774 can be sized and shaped to house a retractable ladder 778. The retractable ladder 778 can extend out through the opening 776. In some embodiments, the retractable ladder 778 may be configured to extend out through the opening 776 when the panel drop down boarding point 770 is in an open position. Further, the extended retractable ladder 778 may be configured to retract into the opening 776 when the panel drop down boarding point 770 is in a closed position and/or moving towards a closed position. In some embodiments, the retractable ladder 778 can rotate at an angle 797. This can be beneficial where a person entering or exiting the water may want a more vertical ladder than could be provided, for example where the panel drop down boarding point 770 does not open to a large enough angle. FIG. 7D illustrates a top cross-sectional view of a portion of a recreational watercraft including a panel drop down boarding point with a retractable ladder in an extended position in accordance with a number of embodiments of the present disclosure.

As shown in FIG. 7D, the portion of the recreational watercraft includes a hull 704, a bow side 706-1, a port side 706-3, and starboard side 706-4. The piston 780 is hingedly attached horizontally to the bow side 706-1. As shown in FIG. 3D, the telescoping piston 780 can be housed in the bow side when in a retracted position. When the piston is extended, the panel drop down boarding point rotates around the lateral axis 792 at or near bottom 771 of the panel drop down boarding point.

The retractable ladder 778 can, as shown in FIG. 7D, can include a center line 791. In some embodiments, the centerline of the ladder and the center of the boarding grip points 793 can be aligned with the center of the rungs 779 along center line 791, as shown in FIG. 7D. This can be beneficial, for example in allowing a person traversing from the ladder to the boarding grip points, or vice versa, to predict the location of the boarding grip points or ladder rungs without looking.

In some embodiments, the panel drop down boarding point can be used as swim platform and/or the swim platform (e.g., 127 of FIG. 1A) can be equipped have one or more pistons (e.g., electrically actuated telescopic pistons). As used herein, the term "swim platform" refers to a staging platform for water sports (e.g., swimming, wakeboarding, skiing, etc.). The panel drop down boarding point can be adjusted based on the water sport of choice. The panel drop down boarding point can also be used as a safe boarding/ recovery point for a fatigued swimmer, tuber, water skier, and/or boarder that is away from a propeller of the boat and within a driver's view.

Figure 8:
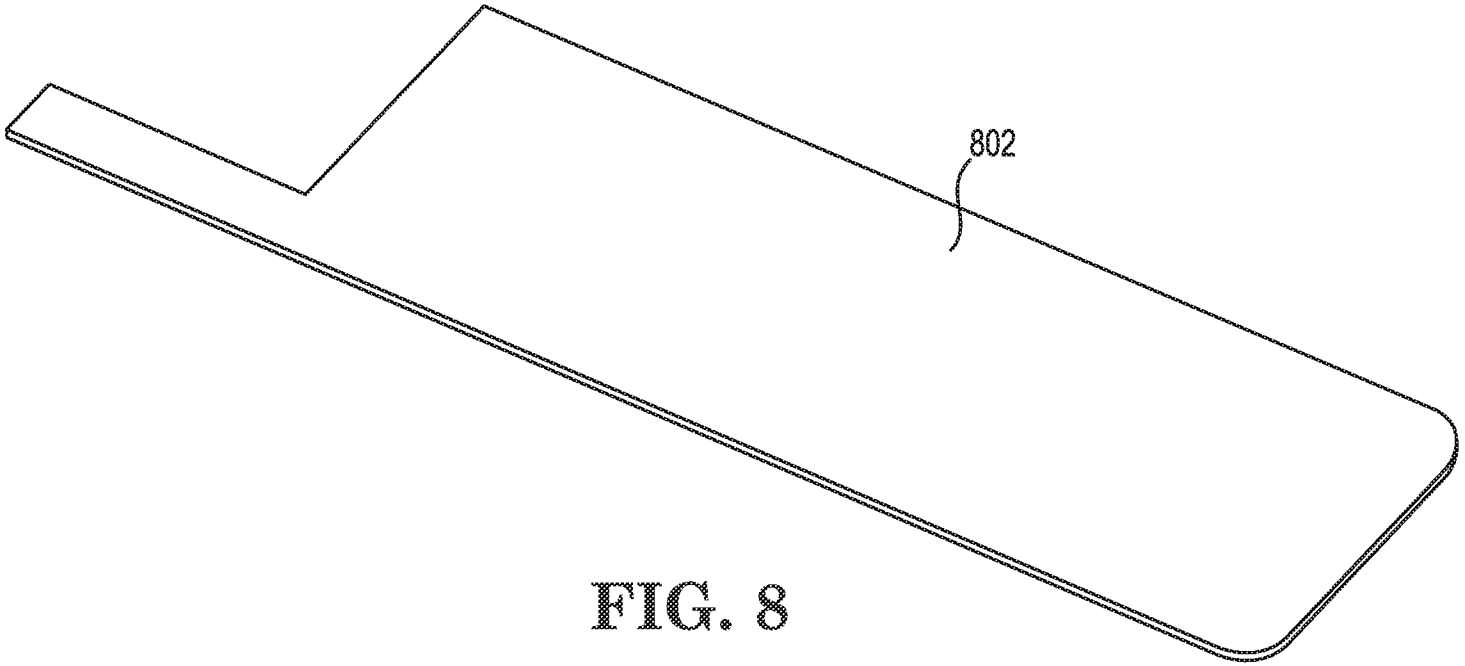
FIG. 8 illustrates a perspective view of an open platform passenger deck layer of a recreational watercraft in accordance with a number of embodiments in the present disclosure.

FIG. 8 illustrates a perspective view of an open platform passenger deck layer of a recreational watercraft in accordance with a number of embodiments in the present disclosure. FIG. 8 provides a depiction of the surface forming the open platform passenger deck layer 802, which is a depiction of the layer 102 of FIG. 1A. Although this layer could be made from multiple sheets of planar material to create the decking shape illustrated, the planar nature of the whole shape allows for the open platform, as shown in FIG. 1A, to be utilized. An embodiment having such a planar decking concept has many benefits. For example, it enables the decking to be attached directly to the aluminum hull, for example, to cross members 222 of FIG. 2A. Such embodiments also allow for more spread out seating, it allows for better access for youth because every decking surface is on the same level, and it allows for the use of doors or drop down boarding points because the decking is at the level of the bottom of the door or boarding point (this can be particularly beneficial for people that have difficulty climbing over the side of traditional water sports-style boats, such as people in wheelchairs, for example).

Although specific embodiments have been illustrated and described herein, those of ordinary skill in the art will appreciate that an arrangement calculated to achieve the same results can be substituted for the specific embodiments shown. This disclosure is intended to cover adaptations or variations of a number of embodiments of the present disclosure. It is to be understood that the above description has been made in an illustrative fashion, and not a restrictive one. Combination of the above embodiments, and other embodiments not specifically described herein will be apparent to those of skill in the art upon reviewing the above description. The scope of a number of embodiments of the present disclosure includes other applications in which the above structures and processes are used. Therefore, the scope of a number of embodiments of the present disclosure should be determined with reference to the appended claims, along with the full range of equivalents to which such claims are entitled.

In the foregoing Detailed Description, some features are grouped together in a single embodiment for the purpose of streamlining the disclosure. This method of disclosure is not to be interpreted as reflecting an intention that the disclosed embodiments of the present disclosure have to use more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A recreational watercraft, comprising:
- a hull;
- a ballast tank;
- a first surface defining a first opening that extends from an interior of the ballast tank to an exterior of the hull, wherein the first surface defining the first opening is configured to be above a surface of a body of water;
- a valve configured to selectively open or close the first opening; and
- a second surface defining a second opening that is fixed permanently open and extends from an interior of the ballast tank through a bottom portion of the hull to an exterior of the hull wherein the second surface defining the second opening is configured to be below the surface of the body of water.

2. The recreational watercraft of claim 1, wherein the first opening extends from the interior of the ballast tank through a side portion of the hull to the exterior of the hull.

3. The recreational watercraft of claim 1, wherein a length of the first surface defining the first opening exceeds a length of the second surface defining the second opening.

4. The recreational watercraft of claim 1, wherein the second opening is located at a stern end of the ballast tank.

5. The recreational watercraft of claim 1, wherein the second opening is located near a centerline of the watercraft.

6. The recreational watercraft of claim 1, wherein the valve is a battery-driven direct current solenoid valve.

7. The recreational watercraft of claim 1, wherein:
- a length of the watercraft is between 15 and 30 feet; and
- a volume of the ballast tank is between 10 and 125 cubic feet.

8. The recreational watercraft of claim 1, wherein:
- a diameter of the first opening is between 0.5 inches and 3.0 inches; and
- a diameter of the second opening is between 2.0 and 5.0 inches.

9. A method of operating a recreational watercraft, comprising:
- providing a hull of a recreational watercraft housing a ballast apparatus, the ballast apparatus comprising:
  - a first surface of a ballast tank defining a first opening that extends from an interior of the ballast tank through a side portion of the hull to an exterior of the side portion of the hull above a surface of a body of water;
  - a valve configured to selectively open or close the first opening; and
  - a second surface defining a second opening that extends from the interior of the ballast tank through a bottom portion of the hull to an exterior of the bottom portion of the hull below the surface of the body of water;
- operating the watercraft in the body of water with the valve in a first position such that the first opening is closed;
- causing the valve to change to a second position such that the first opening is open, whereby a volume of ballast water is received from the body of water by the ballast tank via the second opening, and wherein a corresponding volume of air exits the ballast tank via the first opening; and
- causing the valve to return to the first position such that the first opening is closed and the volume of ballast water is retained in the ballast tank.

10. The method of claim 9, wherein the method includes causing the valve to return to the first position such that the first opening is closed responsive to a signal received from a sensing device associated with the ballast tank.

11. The method of claim 9, wherein the method includes causing the valve to return to the first position such that the first opening is closed responsive to an input made via an interface on a control console.

12. The method of claim 9, wherein the method includes operating the watercraft in the body of water with the valve in the first position and the ballast water retained in the ballast tank.

13. The method of claim 9, wherein the method includes:
- operating the watercraft at a particular speed in the body of water with the valve in the first position and the ballast water retained in the ballast tank;

causing the valve to return to the second position such that the first opening is open while the watercraft is operating at the particular speed, whereby the volume of ballast water is drained into the body of water via the second opening while the watercraft is operating at the particular speed, and wherein the corresponding volume of air is received by the ballast tank via the first opening; and causing the valve to return to the first position such that the first opening is closed while the watercraft is operating at the particular speed.

14. The method of claim 13, wherein operating the watercraft at the particular speed includes operating the watercraft in a range from 8.0 miles per hour to 15 miles per hour.

15. The method of claim 13, wherein operating the watercraft at the particular speed includes operating the watercraft in excess of 8.0 miles per hour.

16. A recreational watercraft, comprising:

a bow and a stern;

a port side and a starboard side;

a hull having an interior and an exterior;

a first ballast apparatus, a second ballast apparatus, and a third ballast apparatus, wherein each of the first ballast apparatus, the second ballast apparatus, and the third ballast apparatus includes:

a ballast tank affixed to the interior of the hull;

a first surface defining a top opening that extends from an interior of the ballast tank to the exterior of the hull;

a valve configured to selectively close the top opening; and a second surface defining a bottom opening that extends from an interior of the ballast tank through a bottom portion of the hull to an exterior of the hull; and a first control element configured to control operation of the first ballast apparatus, a second control element configured to control operation of the second ballast apparatus, a third control element configured to control operation of the third ballast apparatus, and a fourth control element configured to control operation of the first ballast apparatus, the second ballast apparatus, and the third ballast apparatus.

17. The recreational watercraft of claim 16, wherein:

the first ballast tank is located on a port side of the watercraft;

the second ballast tank is located on a starboard side of the watercraft; and the third ballast tank is located on a centerline of the watercraft.

* * * * *